US007515850B2

(12) United States Patent
Hasegawa

(10) Patent No.: US 7,515,850 B2
(45) Date of Patent: Apr. 7, 2009

(54) SHEET CONVEYING APPARATUS AND IMAGE FORMING APPARATUS

(75) Inventor: Kenichi Hasegawa, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 114 days.

(21) Appl. No.: 11/528,420

(22) Filed: Sep. 28, 2006

(65) Prior Publication Data

US 2007/0077104 A1 Apr. 5, 2007

(30) Foreign Application Priority Data

| | | |
|---|---|---|
| Sep. 30, 2005 | (JP) | 2005-287833 |
| Apr. 12, 2006 | (JP) | 2006-109444 |
| Aug. 9, 2006 | (JP) | 2006-216442 |
| Aug. 18, 2006 | (JP) | 2006-223442 |

(51) Int. Cl.
*G03G 15/00* (2006.01)
*G03G 15/20* (2006.01)

(52) U.S. Cl. ..... 399/124; 399/328

(58) Field of Classification Search ..... 399/124, 399/122, 121, 21, 107, 320, 328
See application file for complete search history.

(56) References Cited

U.S. PATENT DOCUMENTS

| | | | | |
|---|---|---|---|---|
| 5,400,123 | A | 3/1995 | Sato et al. | 399/187 |
| 5,956,547 | A * | 9/1999 | Kamei et al. | 399/122 |
| 6,131,009 | A | 10/2000 | Hasegawa | 399/328 |
| 6,253,046 | B1 * | 6/2001 | Horrall et al. | 399/124 |
| 6,496,666 | B2 | 12/2002 | Hayashi et al. | 399/69 |
| 6,591,081 | B2 | 7/2003 | Hasegawa | 399/324 |
| 7,003,246 | B2 * | 2/2006 | Gogate et al. | 399/122 |
| 7,070,182 | B2 | 7/2006 | Hasegawa | 271/307 |
| 7,330,682 | B2 * | 2/2008 | Shinshi | 399/122 |
| 2003/0118382 | A1 * | 6/2003 | Tomatsu | 399/328 |
| 2006/0029411 | A1 | 2/2006 | Ishii et al. | 399/67 |

FOREIGN PATENT DOCUMENTS

| | | | |
|---|---|---|---|
| JP | 57-190978 | A * | 11/1982 |
| JP | 59-067568 | | 4/1984 |
| JP | 62-164077 | | 7/1987 |
| JP | 03-107882 | | 5/1991 |
| JP | 08-220922 | | 8/1996 |
| JP | 09-101696 | | 4/1997 |
| JP | 2001-175114 | | 6/2001 |
| JP | 2001-318555 | A * | 11/2001 |
| JP | 2003-287973 | | 10/2003 |

OTHER PUBLICATIONS

Machine translation of JP 2001-318555 A dated Mar. 18, 2008.*

* cited by examiner

*Primary Examiner*—Sophia S Chen
(74) *Attorney, Agent, or Firm*—Harness, Dickey & Pierce PLC

(57) ABSTRACT

A pressure lever includes an oscillating edge that is capable of contacting a supporting shaft of a pressure roller. An oscillating lever includes a plurality of oscillating edges around a fixed edge. An elastic unit is latched between the fixed edge of the oscillating lever and an immovable portion, and biases the oscillating lever towards one of the rollers. A position of the fixed edge of the oscillating lever is capable of being changed in a state of being deviated from a position before oscillating based on an oscillating position of the oscillating lever separately from an oscillation of the fixed edge.

18 Claims, 22 Drawing Sheets

REALATED ART

RELATED ART

SHEET CONVEYING APPARATUS AND IMAGE FORMING APPARATUS

CROSS-REFERENCE TO RELATED APPLICATIONS

The present document incorporates by reference the entire contents of Japanese priority documents, 2005-287833 filed in Japan on Sep. 30, 2005, 2006-109444 filed in Japan on Apr. 12, 2006, 2006-216442 filed in Japan on Aug. 9, 2006 and 2006-223442 filed in Japan on Aug. 18, 2006.

BACKGROUND OF THE INVENTION

1. Field of the Invention

The present invention relates to a sheet conveying apparatus and an image forming apparatus, and more particularly, to a pressure mechanism for a pair of rollers for conveying a sheet.

2. Description of the Related Art

In an electrophotographic image forming apparatus or an electrostatic image forming apparatus that is well known to those-skilled in the art recently, when an electrostatic latent image corresponding to an image signal is formed on a uniformly charged photoreceptor as a carrier of the latent image, the electrostatic latent image is visualized by a toner supplied from a developing unit.

A toner image carried on the photoreceptor is transferred onto a recording sheet as a recording medium, and fixed on a sheet P by melting and impregnating the toner with heat and a pressure provided from a fixing device. The fixing device disclosed in Japanese Patent No. 3243143 employs the heat roller fixing method. The fixing device includes a heat roller as a fixing member and a pressure roller located in front of the heat roller. The sheet P is held between the heat roller and the pressure roller, and conveyed by a rotation of the rollers.

The heat roller fixing method disclosed in Japanese Patent Application Laid-open No. S59-67568 and Japanese Patent Application Laid-open No. S62-164077 includes forming a nip portion where the sheet P is held between the rollers. In the nip portion, the heat roller heats the sheet P being conveyed. Therefore, the nip portion is required for providing the heat efficiently, and the rollers forming the nip portion are to be contacted each other with a strong pressure.

The fixing device disclosed in Japanese Patent Application Laid-open No. S59-67568 further includes a pressure lever as an oscillating member that can contact a bearing of the pressure roller, an oscillating lever supported on the same shaft of the pressure lever such that the oscillating lever and the pressure lever pull each other via a spring coupled thereto, and an oscillatable release lever that is arranged in the opposite side to an oscillating edge of the oscillating lever and includes a hook unit removably attached to a portion of the oscillating edge. When the oscillating edge of the oscillating lever is displaced according to an oscillating position of the release lever, the pressure lever moves away from the bearing of the pressure roller via the spring coupled to the oscillating edge, and the pressure roller is set up to be in either the pressurizing condition or the pressure-released condition.

In the fixing device disclosed in Japanese Patent Application Laid-open No. S62-164077, the pressure roller is located on an oscillatable supporting member, and the oscillatable oscillating lever that drives the pressure roller to contact or move away from a fixing roller is located on the oscillating edge side of the supporting member, and an elastic bias spring is attached to near a fulcrum shaft of the oscillating lever. In the configuration above, when a position where the spring is attached is displaced to either one side centering around the fulcrum shaft as a dead point according to an oscillating position of the oscillating lever, the pressure roller is maintained at either a pressurizing position or a pressure-released position against the fixing roller.

In the image forming apparatus including the fixing device disclosed in Japanese Patent Application Laid-open No. H9-101696, Japanese Patent Application Laid-open No. 2003-287973, and Japanese Patent Application Laid-open No. S59-067568, when the sheet P is jammed in the nip portion where the pressure roller contacts and pressurizes the fixing roller, a user can open a side cover of the image forming apparatus including the fixing device and remove the sheet P jammed therein. The fixing device includes a pressure mechanism such that the pressure roller is released to pressurize the fixing roller when the side cover is opened. Therefore, the user can easily remove the sheet P jammed therein.

The detail of the pressure mechanism is described below with assigning reference numerals used in embodiments. FIG. 24A is a diagram for explaining the pressure mechanism of the fixing device disclosed in Japanese Patent Application Laid-open No. S59-67568 when a pressure roller 302 pressurizes a fixing roller 301. When the pressure roller 302 contacts and pressurizes the fixing roller 301 located in front of the pressure roller 302, a bearing 316 of the pressure roller 302 is pressed by a pressure lever 303. The pressure lever 303 is oscillatably supported by a rotating shaft 310 supported by an immovable portion (not shown), and contacts the bearing 316. An oscillating lever 304 and the pressure lever 303 are oscillatably supported by a supporting shaft 307. One end of a spring 305 is attached to a latch position T1 in an oscillating edge 306A of the oscillating lever 304, which is near the supporting shaft 307, by a latch pin 309.

Another end of the spring 305 is attached to a latch position T2 that is an immovable portion. The supporting shaft 307 of the oscillating lever 304 is offset from a center of the spring 305, so that the spring 305 is expanded without interfering the supporting shaft 307.

The oscillating edge 306A of the oscillating lever 304 is divided into a plurality of edges centering around the supporting shaft 307. Namely, the oscillating edge 306A is the so-called "two-forked" as shown in FIG. 24B. The latch pin 309 penetrates through the two-forked oscillating edge 306A and fixes the end of the spring 305 to the latch position T1. A liner portion extending from an oscillating edge 306B to the oscillating edge 306A is pressed and moved by a press roller 313 included in a clamp lever 311. Therefore, an oscillating-lever supporting pin 312 included in the oscillating lever 304 is removably attached to a hook unit 328 located in the front edge of the clamp lever 311.

When the oscillating-lever supporting pin 312 strikes on the pressure lever 303, the oscillating lever 304 is restricted rotating to a position shown in FIG. 24A, so that the oscillating lever 304 can not move to the left side farther on. Therefore, the pressure roller 302 can surely pressurize the fixing roller 301.

In an image forming apparatus according to an embodiment of the present invention shown-in FIG. 1, for example, the clamp lever 311 is integrated with an open-close side cover 202. When the side cover 202 is closed, the oscillating-lever supporting pin 312 is pressed and moved by the press roller 313 located in front of the liner portion between the oscillating edges 306A and 306B, and the oscillating lever 304 is restricted to a displacement. When the side cover 202 is opened, the hook unit 328 located in the front edge of the clamp lever 311 is engaged with the oscillating-lever supporting pin 312, and then the oscillating lever 304 rotates according to the oscillating-lever supporting pin 312 being pulled.

In FIG. 24A, the pressure roller 302 contacts and pressurizes the fixing roller 301 so as to form a nip portion N where an outer peripheral surface of the pressure roller 302 is nipped into an outer peripheral surface of the fixing roller 301 partially. While oscillating the oscillating lever 304, when the both latch positions T1 and T2 of the spring 305 and the supporting shaft 307 of the oscillating lever 304 are aligned, an amount of tension in the spring 305 becomes the maximum amount M1. Namely, the maximum amount of tension in the spring 305 is generated at the time. When the latch position T1 of the spring 305 goes over the dead point, in which the both latch positions T1 and T2 and the supporting shaft 307 are aligned, in any direction, the amount of tension in the spring 305 (M2 in FIG. 25) is smaller than M1 that is the amount of tension in the spring 305 at the dead point. Furthermore, a moment, in which the supporting shaft 307 works as a point of support and M2 works as a point of application, is generated by the traction force caused by a contraction of the spring 305.

When the pressurizing condition of the pressure roller 302 is to be released, the side cover 202 is opened, and the oscillating-lever supporting pin 312 is pulled by the hook unit 328 located in the front edge of a release lever 320. Therefore, the restriction on displacing the oscillating lever 304 is released, and the oscillating lever 304 is allowed to rotate clockwise.

When the both latch positions T1 and T2 of the spring 305 and the supporting shaft 307 of the oscillating lever 304 are aligned, namely, at the dead point, the maximum tension in the spring 305 is generated (see FIG. 24A). As shown in FIG. 25, when the oscillating lever 304 rotates clockwise, the spring 305 is contracted, and the amount of tension in the spring 305 is decreased, and a position (P1) of the supporting shaft 307 is displaced in a counterclockwise direction by the restoring force acting on the pressure roller 302 via the fixing roller 301, and then the pressure lever 303 rotates and moves away from the bearing 316. Thus, the pressure roller 302 is released to pressurize the fixing roller 301.

However, there is a problem in the configuration. The oscillating lever 304 is required to rotate at a relatively large amount of rotation for displacing the rotating shaft 310, but it may be difficult to obtain the sufficient amount of rotation because of interference between peripheral members and the oscillating lever 304 depending on those positions. Therefore, the spring 305 is not contracted sufficiently, and the enough amount of rotation for releasing the pressurization is not obtained.

FIG. 25 is a diagram for explaining the pressure mechanism of the fixing device disclosed in Japanese Patent Application Laid-open No. S59-67568 when the pressure roller 302 is released to pressurize the fixing roller 301. The portions identical to those in FIGS. 24A and 24B are denoted with the same reference numerals and the descriptions of the portions are omitted. When a conveying error of the sheet P, the so-called "paper jam", occurs, the side cover 202 is opened, and the pressure roller 302 is released to pressurize the fixing roller 301. After fixing the paper jam, it may happen that the side cover 202 is closed even though the oscillating lever 304 is not yet returned back.

When the rotation amount of the oscillating lever 304 increases because of releasing the pressurization of the pressure roller 302, the oscillating-lever supporting pin 312 may move out from a movement path of the hook unit 328 where the oscillating-lever supporting pin 312 is engaged, and further the liner portion between the oscillating edges 306A and 306B may move out from a movement path of the press roller 313.

In this case, it may fail to set up the pressurizing condition of the pressure roller 302, because the liner portion is not pressed by the press roller 313 even though the side cover 202 is closed. Namely, even though the side cover 202 is closed improperly, it may happen that the pressurizing condition of the pressure roller 302 cannot be set up, because the oscillating lever 304 is not returned back. Therefore, when the oscillating edge 306B presses the pressure roller 302, a required pressing force of the press roller 313 is getting increased. Furthermore, a resistance to closing the side cover 202 is also getting increased. Thus, the operability in closing the side cover 202 decreases.

SUMMARY OF THE INVENTION

It is an object of the present invention to at least partially solve the problems in the conventional technology.

A sheet conveying apparatus according to one aspect of the present invention includes a conveying unit that conveys a sheet by holding in a nip portion, the nip portion formed by a pair of rollers as a rotating unit such that one of the pair of rollers contacts and pressurizes the other roller; a pressure lever of which a fixed edge is oscillatably supported by a immovable portion, the pressure lever including an oscillating edge, the oscillating edge of the pressure lever being capable of contacting a supporting shaft of the pressure roller; an oscillating lever of which a fixed edge is oscillatably supported by the pressure lever in the oscillating edge side, the oscillating lever including a plurality of oscillating edges around the fixed edge; and an elastic unit that is latched between the fixed edge of the oscillating lever and the immovable portion, and biases the oscillating lever towards the one of the pair of rollers. A position of the fixed edge of the oscillating lever, from among positions at which an end of the elastic unit is latched on, is capable of being changed in a state of being deviated from a position before oscillating based on an oscillating position of the oscillating lever separately from an oscillation of the fixed edge.

A sheet conveying apparatus according to another aspect of the present invention includes a conveying unit that conveys a sheet by holding in a nip portion, the nip portion formed by a pair of rollers as a rotating unit such that one of the pair of rollers contacts and pressurizes the other roller; a pressure lever which fixed edge is oscillatably supported by a fixed supporting unit, the pressure lever including a pressurizing unit that can contact a rotating shaft of the pressure roller; and a press lever which fixed edge is oscillatably supported by the pressure lever in the oscillating edge side, the press lever pressing the oscillating lever to oscillate from a pressure-released position to a pressurizing position. While the press lever presses the oscillating lever to oscillate from the pressure-released position to the pressurizing position, the press lever oscillates to move away from a supporting point of the oscillating lever.

An image forming apparatus according to still another aspect of the present invention includes a sheet conveying apparatus including a conveying unit that conveys a sheet by holding in a nip portion, the nip portion formed by a pair of rollers as a rotating unit such that one of the pair of rollers contacts and pressurizes the other roller; a pressure lever of which a fixed edge is oscillatably supported by a immovable portion, the pressure lever including an oscillating edge, the oscillating edge of the pressure lever being capable of contacting a supporting shaft of the pressure roller; an oscillating lever of which a fixed edge is oscillatably supported by the pressure lever in the oscillating edge side, the oscillating lever including a plurality of oscillating edges around the fixed edge; and an elastic unit that is latched between the fixed edge of the oscillating lever and the immovable portion, and biases the oscillating lever towards the one of the pair of rollers. A position of the fixed edge of the oscillating lever, from among positions at which an end of the elastic unit is latched on, is capable of being changed in a state of being deviated from a position before oscillating based on an oscillating position of the oscillating lever separately from an oscillation of the fixed edge.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
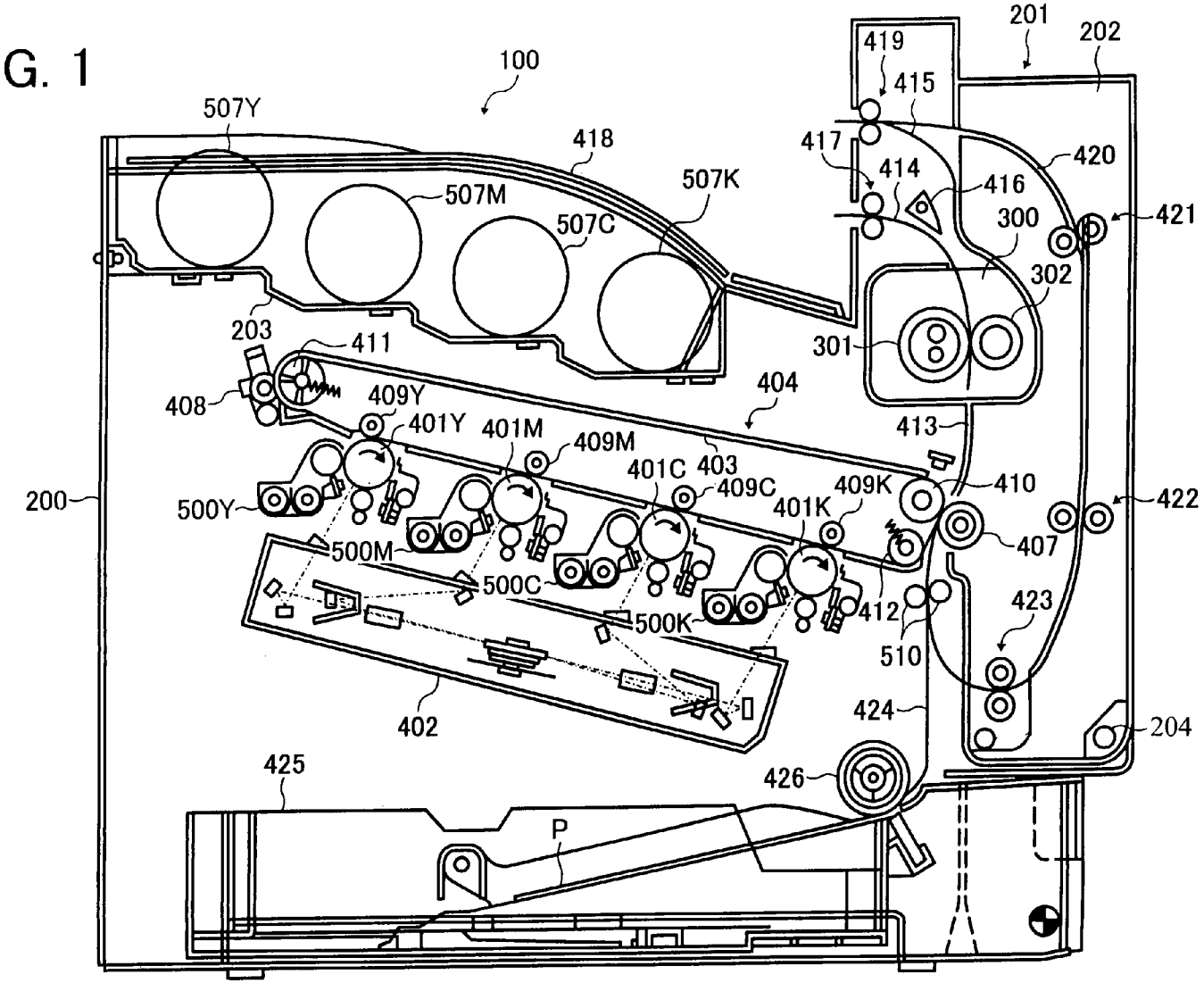
FIG. 1 is a side view of an image forming apparatus according to a first embodiment of the present invention for explaining an internal configuration of the image forming apparatus.
Figure 2:
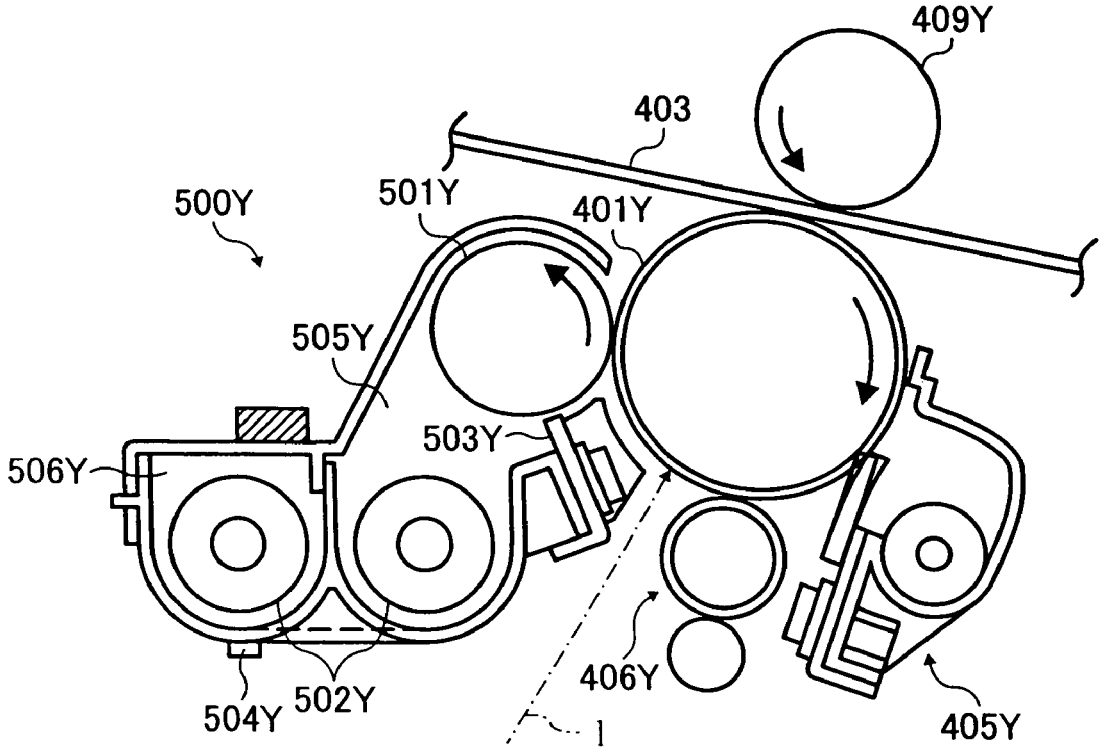
FIG. 2 is an enlarged diagram of a process cartridge for yellow color and peripheral members in the image forming apparatus according to the first embodiment.

FIG. 1 is a side view of an image forming apparatus 100 according to a first embodiment for explaining an internal configuration of the image forming apparatus. First, the basic configuration of the image forming apparatus 100 is described below. The image forming apparatus 100 includes four process cartridges (not shown) that respectively generate yellow (Y), magenta (M), cyan (C), and black (K) toner images. Each of the process cartridges use different color toner as an image forming substance, but all of the process cartridges have the same configuration. At the end of an operating life of a process cartridge, the process cartridge is replaced with a new one. The process cartridge that generates a Y toner image is described below as an example. As shown in FIG. 2, the process cartridge includes a photosensitive drum 401Y, a drum cleaning unit 405Y, a charge neutralizing device (not shown), a charging unit 406Y, a developing unit 500Y, and the like. The process cartridge as an image forming unit is removably attached to a main body of the image forming apparatus 100. When any component of the process cartridge is worn out, the process cartridge is replaced with a new one.

The charging unit 406Y uniformly charges a surface of the photosensitive drum 401Y that is rotated clockwise by a driving unit (not shown). An electrostatic latent image for Y color is carried on the uniformly-charged surface of the photosensitive drum 401Y that is exposed to a laser beam l by scanning. The electrostatic latent image for Y color is developed into a Y toner image by the developing unit 500Y with a Y developer including a Y toner and a magnetic carrier. Then, the Y toner image is intermediately transferred onto an intermediate transfer belt 403. After the intermediate transfer, the drum cleaning unit 405Y removes residual Y toner from the surface of the photosensitive drum 401Y. After the residual Y toner is removed, the charge neutralizing device neutralizes residual electric charge from the photosensitive drum 401Y. After the charge neutralization, the surface of the photosensitive drum 401Y is initialized and prepared for the following image forming process. In the same manner as the process cartridge describes above, the other process cartridges form M, C, and K toner images on photosensitive drums 401M, 401C, and 401K respectively. The M, C, and K toner images formed on the photosensitive drums 401M, 401C, and 401K are intermediately transferred onto the intermediate transfer belt 403.

The developing unit 500Y includes a developing roller 501Y that is arranged to be partially exposed from a casing opening of the developing unit 500Y, two conveying screws 502Y that are arranged in parallel, a doctor blade 503Y, a toner density sensor (hereinafter "T-sensor") 504Y, and the like.

The Y developer including the magnetic carrier and the Y toner is contained in the casing of the developing unit 500Y. After the Y developer is stirred by the conveying screws 502Y and charged by friction, the Y developer is carried on a surface of the developing roller 501Y. A layer thickness of the Y developer is leveled uniformly by the doctor blade 503Y, and the Y developer with the predetermined layer thickness is conveyed to a developing area in front of the photosensitive drum 401Y, and fixed into the electrostatic latent image on the photosensitive drum 401Y. Therefore, the Y toner image is formed on the photosensitive drum 401Y. The Y developer that the Y toner is consumed in developing in the developing unit 500Y is returned back in the casing by a rotation of the developing roller 501Y.

A partition is located between the conveying screws 502Y. The partition divides the casing into two sections, a first supplying unit 505Y and a second supplying unit 506Y. The first supplying unit 505Y contains the developing roller 501Y and the right side conveying screw 502Y. The second supplying unit 506Y contains the left side conveying screw 502Y. The right side conveying screw 502Y is driven to rotate by a driving unit (not shown), and conveys the Y developer in the first supplying unit 505Y from the front side to the rear side, and supplies the Y developer to the developing roller 501Y.

The Y developer conveyed near the rear end of the first supplying unit 505Y by the right side conveying screw 502Y enters into the second supplying unit 506Y through an outlet (not shown) of the partition. In the second supplying unit 506Y, the left side conveying screw 502Y is driven to rotate by a driving unit (not shown), and conveys the Y developer in the opposite direction to the conveying direction in the right side conveying screw 502Y.

The Y developer conveyed near the end of the second supplying unit 506Y by the left side conveying screw 502Y is returned back into the first supplying unit 505Y through an inlet (not shown) of the partition.

The T-sensor 504Y including a magnetic permeability sensor is arranged on the bottom wall of the second supplying unit 506Y, and outputs a voltage corresponding to the magnetic permeability of the Y developer passing thereon. The magnetic permeability of a two-component developer including a toner and a magnetic carrier correlates well with the toner density. Therefore, in other words, the T-sensor 504Y outputs a voltage corresponding to the Y toner density. The output voltage is transmitted to a controlling unit (not shown). The controlling unit includes a random access memory (RAM) storing data for a voltage reference (Vtref) for the Y toner that is a target voltage for the voltage output from the T-sensor 504Y. The RAM also stores data for Vtref for M, C, and K toner included in other developing units that are target voltages for voltages output from T-sensors (not shown).

The Vtref for the Y toner is used to control to drive a Y toner conveying device (not shown). More specifically, the controlling unit controls to drive the Y toner conveying device so as to make the voltage output from the T-sensor 504Y close to the Vtref for the Y toner, and the Y toner is supplied into the second supplying unit 506Y. The Y toner density of the Y developer in the developing unit 500Y is maintained within a predetermined range. In other developing units for the process cartridges 400M, 400C, and 400K, supplies of the M, C, and K toners are controlled by M, C, and K toner conveying devices respectively.

An exposing unit 402 as a latent image forming unit is arranged under the process cartridges (see FIG. 1). In the exposing unit 402, the photosensitive drums 401Y, 401M, 401C, and 401K are illuminated and exposed by the laser beam l emitted from a light source according to image information, and electrostatic latent images for the Y, M, C, and K colors are formed on the exposed photosensitive drums 401Y, 401M, 401C, and 401K respectively. Furthermore, in the exposing unit 402, the laser beam l is scanned by a polygon mirror that is driven to rotate by a motor, and illuminates the photosensitive drums 401Y, 401M, 401C, and 401K via a plurality of optical lenses or mirrors.

A sheet keeping unit that includes a sheet keeping cassette 425 and a sheet feeding roller 426 built-in the sheet keeping cassette 425 is arranged under the exposing unit 402. The sheet keeping cassette 425 keeps a plurality of sheet P as sheet-like recording mediums in piles. The sheet feeding roller 426 contacts the top piece of the piled sheet P. When the sheet feeding roller 426 is rotated counterclockwise by a driving unit (not shown), the top piece of the sheet P is fed into a sheet feeding path 424. A pair of paper stop rollers 510 are arranged near the end of the sheet feeding path 424. The pair of paper stop rollers 510 rotate each other to hold the sheet P, and stop rotating when the sheet P is held therein. Then, the sheet P is fed into a secondary transferring nip portion in the appropriate timing.

A transfer unit 404 is arranged above the process cartridges. The transfer unit 404 includes the intermediate transfer belt 403 as an intermediate transfer unit, a secondary-transfer bias roller 407, and a belt cleaning unit 408. The transfer unit 404 further includes four primary-transfer bias rollers 409Y, 409M, 409C, and 409K, a secondary transferring backup roller 410, a cleaning backup roller 411, and a tension roller 412. The intermediate transfer belt 403 is spanned around the seven rollers 409Y, 409M, 409C, 409K, 410, 411, and 412, and moved in a loop in a counterclockwise direction by a rotary drive of at least any one of the seven rollers.

The primary-transfer bias rollers 409Y, 409M, 409C, and 409K hold the intermediate transfer belt 403 with photosensitive drums 401Y, 401M, 401C, and 401K respectively, and primary transferring nip portions are formed therein. Therefore, the reverse side (the inner loop) of the intermediate transfer belt 403 is applied to the transfer bias with the straight polarity, which is the reversed polarity of the toner. The rollers other than the primary-transfer bias rollers 409Y, 409M, 409C, and 409K are all electrically earthed. While the intermediate transfer belt 403 passes through the primary transferring nip portions for the Y, M, C, and K toners sequentially, the Y, M, C, and K toner images on the photosensitive drums 401Y, 401M, 401C, and 401K are primarily transferred on the intermediate transfer belt 403. Thus, a four-color overlapped toner image (hereinafter "four-color toner image") is formed on the intermediate transfer belt 403.

The secondary transferring backup roller 410 holds the intermediate transfer belt 403 with the secondary-transfer bias roller 407, and a secondary transferring nip portion is formed therein. The four-color toner image formed on the intermediate transfer belt 403, which is a visible image, is transferred onto the sheet P at the secondary transferring nip portion. The four-color toner image is combined with the white color of the sheet P, and a full-color toner image is generated. After the intermediate transfer belt 403 passes through the secondary transferring nip portion, transfer residual toners that are not transferred onto the sheet P are remained on the intermediate transfer belt 403. The belt cleaning unit 408 removes the transfer residual toners from the intermediate transfer belt 403. The sheet P where the four-color image is secondarily transferred in a batch is fed into a fixing device 300 through a post-transfer sheet conveying path 413.

In the fixing device 300, a fixing nip portion is formed such that the pressure roller 302 rotates and pressurizes the fixing roller 301 including a heat source such as a halogen lamp at a predetermined pressure. The sheet P fed into the fixing device 300 is held at the fixing nip portion. At this time, a front face of the sheet P, where the unfixed full-color toner image is carried, is pressed to the fixing roller 301. The toners included in the full-color toner image are softened by the heat and pressure in the fixing nip portion, and the full-color toner image is fixed on the sheet P.

The sheet P, where the full-color toner image is fixed, is fed from the fixing device 300 to a fork between a sheet discharging path 414 and a pre-reversal conveying path 415. A first switching claw 416 is oscillatably arranged at the fork, and a conveying course of the sheet P is switched by oscillating the first switching claw 416. More specifically, when a tip of the first switching claw 416 is moved to a direction close to the pre-reversal conveying path 415, the conveying course of the sheet P is switched to the sheet discharging path 414. When the tip of the first switching claw 416 is moved to a direction away from the pre-reversal conveying path 415, the conveying course of the sheet P is switched to the pre-reversal conveying path 415.

When the conveying course of the sheet P to the sheet discharging path 414 is selected by the first switching claw 416, the sheet P is fed from the sheet discharging path 414 to outside the image forming apparatus 100 through a pair of sheet discharging rollers 417, and stacked on a discharged-sheet stacking unit 418 located on the top surface of an enclosure 200. When the conveying course of the sheet P to the pre-reversal conveying path 415 is selected by the first switching claw 416, the sheet P is fed into a nip portion between a pair of reverse rollers 419 through the pre-reversal conveying path 415. The pair of reverse rollers 419 rotate and convey the sheet P held therein towards the discharged-sheet stacking unit 418, and stop rotating just before a rear-end of the sheet P is fed into the nip portion, and then start rotating in the reverse direction. Therefore, the sheet P is conveyed in the reverse direction from the rear-end side, and fed into a reverse conveying path 420.

The reverse conveying path 420 extends in a curve from vertically upward to downward, and includes a first pair of reverse conveying rollers 421, a second pair of reverse conveying rollers 422, and a third pair of reverse conveying rollers 423. The sheet P is conveyed by passing through nip portions formed between each of the pair of reverse conveying rollers 421, 422, and 423 sequentially, and turned upside down. Then, the sheet P is returned back to the sheet feeding path 424, and fed into the secondary transferring nip portion again. At this time, a reverse face of the sheet P, where the full-color toner image is not carried previously, is pressed to the intermediate transfer belt 403. A second four-color toner image on the intermediate transfer belt 403 is secondarily transferred in a batch onto the reverse face of the sheet P. Then, the sheet P is stacked on the discharged-sheet stacking unit 418 via the post-transfer sheet conveying path 413, the fixing device 300, the sheet discharging path 414, and the pair of sheet discharging rollers 417. The full-color images are formed on both faces of the sheet P by a reverse conveying operation as described above.

A bottle supporting unit 203 is arranged between the transfer unit 404 and the discharged-sheet stacking unit 418 located above the transfer unit 404. The bottle supporting unit 203 includes toner bottles 507Y, 507M, 507C, and 507K as toner keeping sections in which the Y, M, C, and K toners are kept respectively. The toner bottles 507Y, 507M, 507C, and 507K are aligned with slightly downward-sloped in the order of the toner bottles 507Y, 507M, 507C, and 507K. The Y, M, C, and K toners kept in the toner bottles 507Y, 507M, 507C, and 507K are appropriately supplied to the developing units in the process cartridges by a toner conveying device. The toner bottles 507Y, 507M, 507C, and 507K are removably attached to the main body of the image forming apparatus 100 separately from the process cartridges.

Figure 3:
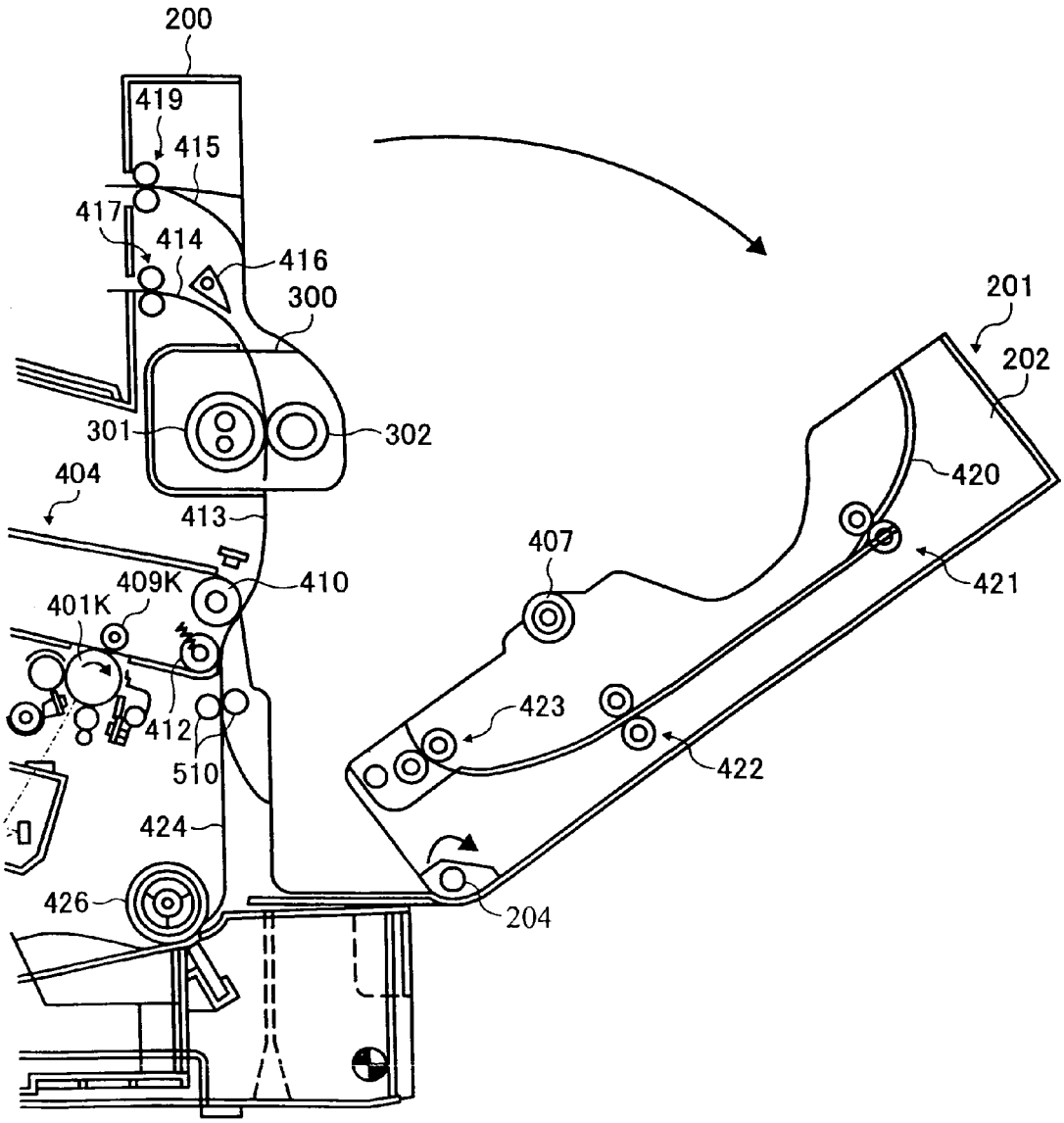
FIG. 3 is a side view of a side cover of the image forming apparatus according to the first embodiment when the side cover is opened.

The side cover 202 of the image forming apparatus 100 can oscillate together with a duplex unit 201 centering around a cover rotating shaft 204 located on the bottom of the side cover 202. Furthermore, the side cover 202 can be opened and closed against the enclosure 200. FIG. 3 depicts a state when the side cover 202 is opened.

When the side cover 202 is closed to the enclosure 200, a sheet path from the post-transfer sheet conveying path 413 or the fixing device 300 to outside the image forming apparatus 100 is formed between the enclosure 200 and the side cover 202 as shown in FIG. 1. When the side cover 202 is opened by rotating clockwise centering around the cover rotating shaft 204, the duplex unit 201 moves away from the enclosure 200. Therefore, the sheet path is exposed outside, so that a user can easily remove the sheet P jammed in the sheet path.

Namely, the fixing device 300 includes a pressure mechanism 315 such that the pressure roller 302 is released to pressurize the fixing roller 301 when the duplex unit 201 moves away from the enclosure 200. In the image forming apparatus 100, when a paper jam occurs in the sheet discharging path 414 extending from the sheet keeping cassette 425 to the pair of sheet discharging rollers 417, the side cover 202 is to be opened to remove the sheet P jammed therein as shown in FIG. 3.

The pressure mechanism in the fixing device 300 according to the first embodiment is described below. In the fixing device 300, the pressure roller 302 and the fixing roller 301 contact and rotate each other, and a nip portion, where a partial outer peripheral surface of the pressure roller 302 and a partial outer peripheral surface of the fixing roller 301 are nipped, is formed, and holds the sheet P therein. The fixing roller 301 contacts an image in one side across the nip portion, and the sheet P is pressed on the fixing roller 301 by the pressure roller 302 in the other side. The pressure roller 302 contacts or moves away from the fixing roller 301 depending on conditions. The supporting structure, in other words, the pressure mechanism 315 is described below with reference to FIGS. 4 and 5.

Figure 4:
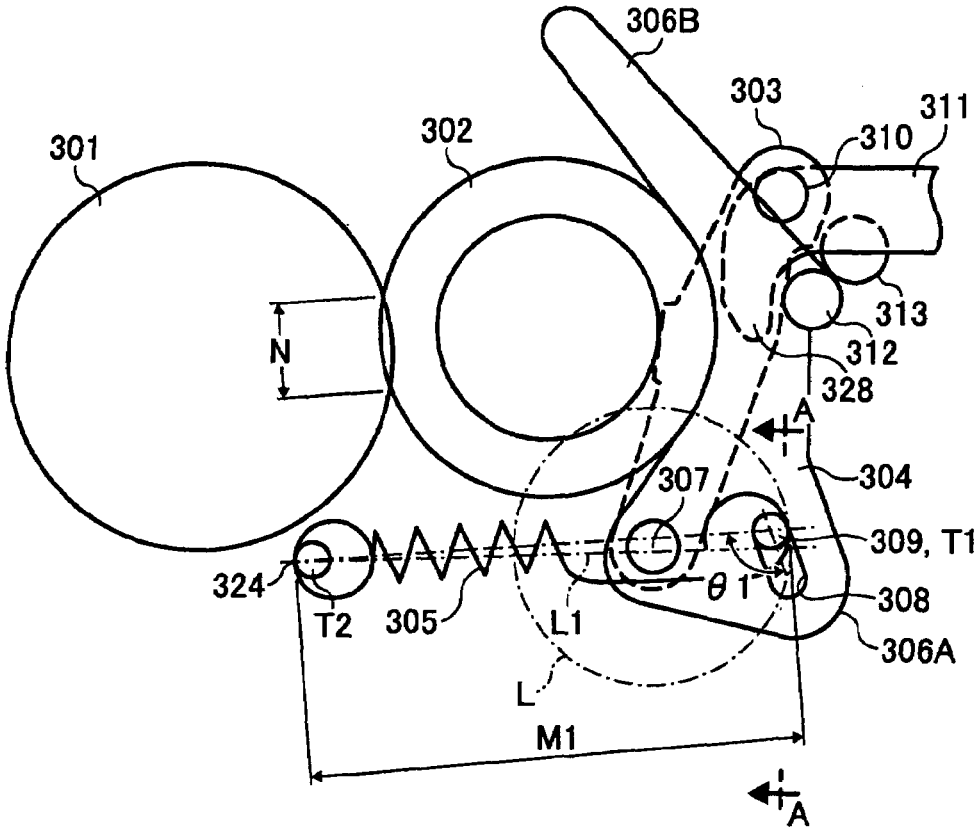
FIG. 4 is a diagram for explaining the pressurizing condition of a fixing device according to the first embodiment.
Figure 5:
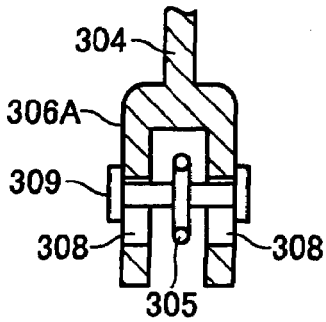
FIG. 5 is a cross-sectional view of the fixing device along the line A-A in FIG. 4.
Figure 24A:
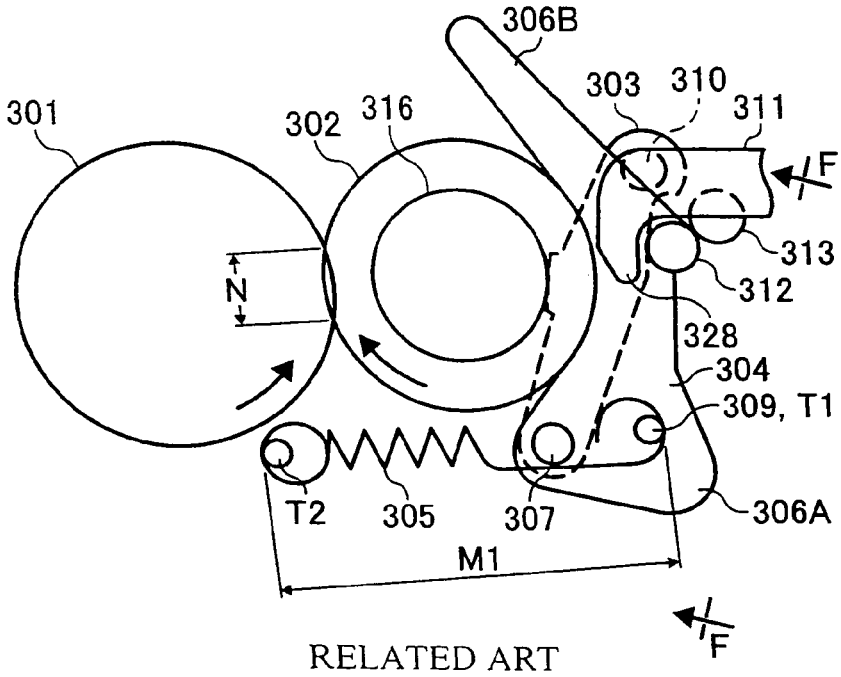
FIG. 24A is a diagram for explaining the pressurizing condition of a pressure mechanism in the fixing device according to the conventional technology.
Figure 24B:
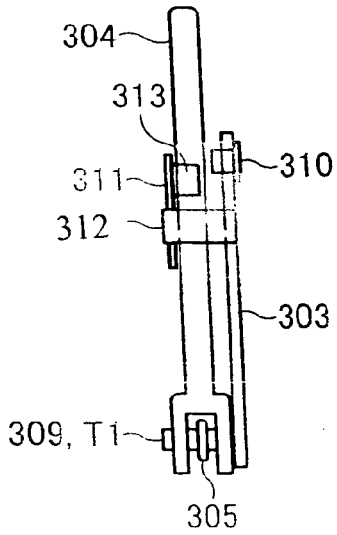
RELATED ART FIG. 24B
FIG. 24B is a cross-sectional view of the fixing device along the line F-F in FIG. 24A.
Figure 25:
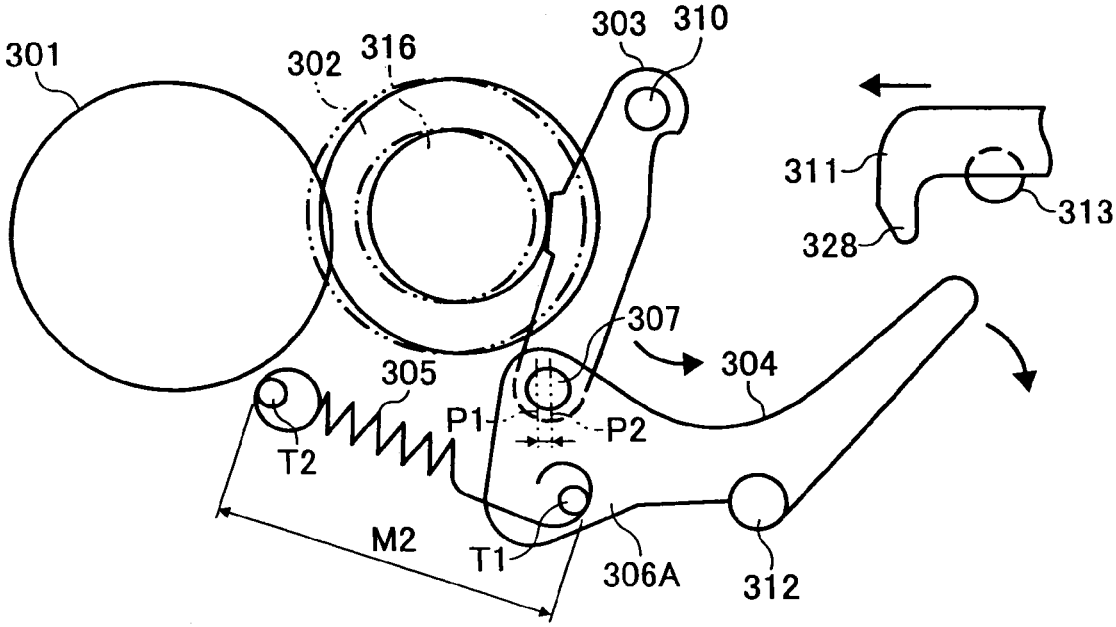
FIG. 25 is a diagram for explaining the pressure-released condition of the pressure mechanism in the fixing device according to the conventional technology.

The configuration as shown in FIGS. 4 and 5 is different from the configuration as shown in FIGS. 24A, 24B, and 25 in the following point. One end of the spring 305 as an elastic member is latched onto the enclosure 200 corresponding to the immovable portion, and the other end of the spring 305 is latched onto the oscillating edge 306A of the oscillating lever 304. The end of the spring 305 that is latched onto the oscillating edge 306A can be displaced in the configuration in FIGS. 4 and 5.

Namely, in the spring 305 latched between the oscillating lever 304 and the enclosure 200 in FIG. 4, a latch position T1, where the end of the spring 305 is latched onto the two-forked oscillating edge 306A by the latch pin 309 near a branch of the oscillating lever 304, is displaced to a different position according to an oscillating position of the oscillating lever 304.

A principle of the displacement is described below. As shown in FIG. 4, a longitudinal long hole 308 that is along a direction approaching a tangent to an oscillating locus L centering around the supporting shaft 307 is formed on the latch position T1, and the latch pin 309 that latches the end of the spring 305 on the oscillating edge 306A is put in the long hole 308. The other end of the spring 305 is fixed to an immovable latch position T2 by a spring hooking lug 324.

FIG. 5 is a cross-sectional view of the fixing device 300 along the line A-A in FIG. 4. The latch pin 309 is inserted into the long holes 308 formed on both sides of the two-forked oscillating edge 306A, and the end of the spring 305 is latched on the center of the latch pin 309 in an axial direction. The long holes 308 are displaced along the oscillating locus L centering around the supporting shaft 307 according to the oscillating position of the oscillating lever 304 as shown in FIG. 4. When the latch pin 309 is aligned with the latch position T2 and the supporting shaft 307 on a dotted line L1 in FIG. 4, the each member is located at a dead point.

The maximum tension of the spring 305 is generated at the time. Namely, an amount of the tension in the spring 305 is maximum M1. When the latch position T1 of the spring 305 is displaced from the dotted line L1, the long hole 308 is also displaced either upward or downward depending on a moving direction of the latch position T1 that is moved by a traction force caused by a contraction of the spring 305 (in the same manner as M2 in FIG. 25).

Figure 6:
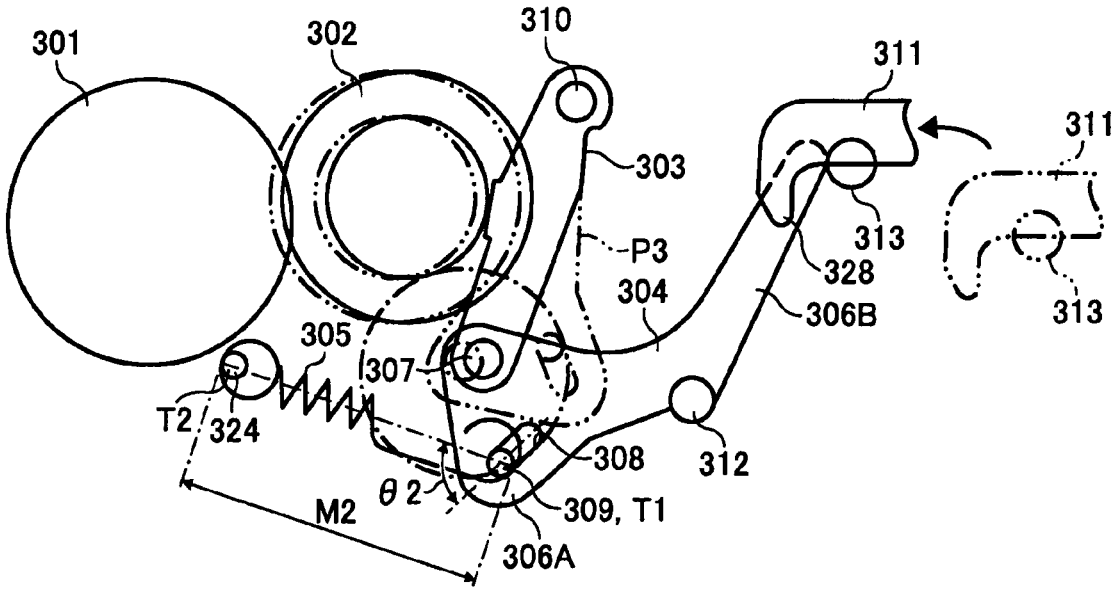
FIG. 6 is a diagram for explaining the pressure-released condition of the fixing device according to the first embodiment.

FIG. 6 is a diagram of the fixing device 300 according to the first embodiment in the pressure-released condition. Under the condition, the latch position T1 of the spring 305 is displaced downward. Therefore, the latch pin 309 located on the latch position T1 of the spring 305 is also displaced downward separately from an oscillating movement of the oscillating lever 304, and an application direction of a moment caused by the traction force of the spring 305 is also changed.

The latch pin 309 is not fixed to near the branch of the oscillating lever 304, but freely displaced within the long hole 308. Therefore, the application direction of the moment that determines a position of the oscillating lever 304 either to be biased against the pressure roller 302 or to be moved away from the pressure roller 302 can be set up even though the oscillating lever 304 does not rotate so much.

When the application direction of the moment to the oscillating lever 304 is to be changed, not only an oscillating amount (a rotation stroke) of the oscillating lever 304 but also a displacing amount of the latch pin 309 can be utilized. Therefore, the oscillating amount of the oscillating lever 304 can be reduced. In addition, reference numeral P3 in FIG. 6 denotes a position of the oscillating lever 304 in FIG. 4.

In the first embodiment, the displacing amount of the latch pin 309 in the long hole 308 is six millimeters. When the latch pin 309 latched on the latch position T1 is displaced upward over the dead point where the latch positions T1 and T2, and the supporting shaft 307 of the oscillating lever 304 are aligned on the L1 (see FIG. 4), the longitudinal direction of the long hole 308 is defined such that an angle θ1 between an extension of the spring 305 and the longitudinal direction of the long hole 308 is within the range from 100 to 120 degrees.

When the latch pin 309 latched on the latch position T1 is displaced downward over the dead point as shown in FIG. 6, the oscillating lever 304 is maintained to be moved away from the pressure roller 302 such that an angle θ2 between the extension of the spring 305 and the longitudinal direction of the long hole 308 is less than 90 degrees. In this case, the oscillating movement while the oscillating lever 304 moves away from the pressure roller 302 is identical to the case as shown in FIG. 25 such that the pressure lever 303 oscillates to be moved away from the pressure roller 302 centering around the rotating shaft 310 in conjunction with a displacement of the supporting shaft 307 of the oscillating lever 304 (from P1 to P2 in FIG. 25) because of the restoring force caused from the fixing roller 301 and releasing the bias force of the spring 305.

Inventors of the present invention measured, under the conditions as described above, an oscillating amount (rotating angle) of the oscillating lever 304 that biases the pressure roller 302 (see FIG. 4) when the angle θ1 between the extension of the spring 305 and the longitudinal direction of the long hole 308 is 105 degrees. As a result, the oscillating amount (rotating angle) θ2 of the oscillating lever 304 was 68 degrees when the oscillating lever 304 is set up to be away from the pressure roller 302 as shown in FIG. 6.

If the latch pin 309 latched on the latch position T1 is fixed to the oscillating lever 304, the oscillating lever 304 needs to oscillate until the latch pin 309 moves to the same position as a case that the latch pin 309 moves by itself with using the attractive force of the spring 305 being contracted. Therefore, the oscillating amount (rotating angle) of the oscillating lever 304 increases because the latch pin 309 does not move by itself.

In addition, another oscillating edge 306B of the oscillating lever 304 can be located on a movement path of the clamp lever 311. Therefore, the press roller 313 included in the clamp lever 311 can move to press the oscillating edge 306B of the oscillating lever 304 according to a sliding movement of the clamp lever 311. Furthermore, the oscillating lever 304 can bias towards the pressure roller 302 by closing the side cover 202 integrated with the clamp lever 311. In addition, positions of the oscillating lever 304 and the pressure roller 302 in FIG. 6 are maintained by a stopper (not shown). Namely, a liner portion between the oscillating edges 306B and 306A of the oscillating lever 304 is on the movement path of the press roller 313.

When the clamp lever 311 moves to the left side, the liner portion between the oscillating edges 306B and 306A is pressed by the press roller 313. As a result, the oscillating lever 304 can rotate towards the pressure lever 303. Therefore, the side cover 202 opened from the enclosure 200 (see FIG. 3) rotates in a closing direction. When the clamp lever 311 oscillates in conjunction with a rotation of the side cover 202, the clamp lever 311 moves from a position indicated by the solid line to a position indicated by the two-dotted line in FIG. 6.

When the clamp lever 311 is pushed towards the pressure lever 303, the liner portion between the oscillating edges 306B and 306A is pressed by the press roller 313 included in the clamp lever 311, and then the oscillating lever 304 starts rotating. In the event, the oscillating-lever supporting pin 312 included in the oscillating lever 304 is put in the hook unit 328 located at a front edge of the clamp lever 311, and the hook unit 328 shifts to a position as shown in FIG. 4.

Reference numeral M2 in FIG. 6 denotes a free length of the spring 305. The pressure-released condition of the spring 305 is maintained without interfering in the lever or the like due to the bias force of the spring 305 by setting conditions of the long hole 308, for instance, a length and a longitudinal direction of the long hole 308.

As described above, in the fixing device according to the first embodiment, the oscillating amount (rotating angle) of the oscillating lever 304 can be reduced. As a result, the oscillating edge 306A of the oscillating lever 304 does not move out from the movement locus of the clamp lever 311. Thus, when the side cover 202 in the image forming apparatus 100 is closed after fixing a paper jam, the pressurizing condition of the pressure roller 302 can be set up even though a user does not return back the oscillating lever 304.

Furthermore, the latch position T1, where the latch pin 309 is latched on the oscillating lever 304, can be displaced with a simple configuration such as the long hole 308, so that the pressurizing condition of the pressure roller 302 can be set up upon a closing operation of the side cover 202 without using a complicated configure, and further the oscillating amount (rotating angle) of the oscillating lever 304 can be reduced.

Figure 7:
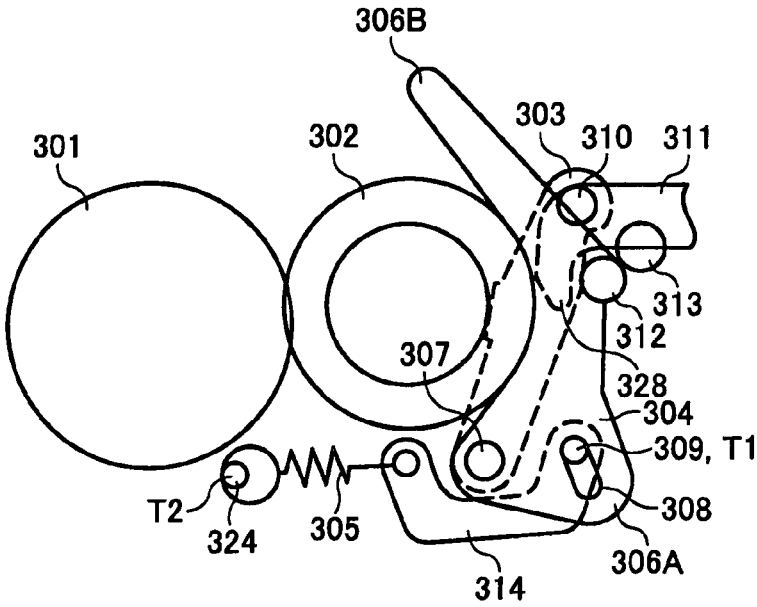
FIG. 7 is a diagram for explaining the pressurizing condition of the fixing device according to a second embodiment.

The pressure mechanism 315 in the fixing device 300 according to a second embodiment is described below. An internal configuration of the image forming apparatus according to the second embodiment is identical to that in the first embodiment. The portions identical to those in the first embodiment are denoted with the same reference numerals and the descriptions of the portions are omitted. FIG. 7 is a diagram of the pressure mechanism 315 in the fixing device 300 according to the second embodiment, and it is identical to FIG. 4. The portions identical to those in FIG. 4 are denoted with the same reference numerals and the descriptions of the portions are omitted.

Differences between the first and second embodiments are as follows. In the fixing device 300 according to the second embodiment, the latch pin 309 is put in the end of the long hole 308, which is located at the oscillating edge 306A of the oscillating lever 304, and further holds one end of a connecting lever 314 shaped to bypass the supporting shaft 307. The other end of the connecting lever 314 is hung with one end of the spring 305. The other end of the spring 305 is fixed to the immovable latch position T2 by the spring hooking lug 324.

In the fixing device 300 according to the second embodiment, it is not necessary to include a specific spring-shaped structural member, and a common extended-shaped spring is acceptable.

Figure 8:
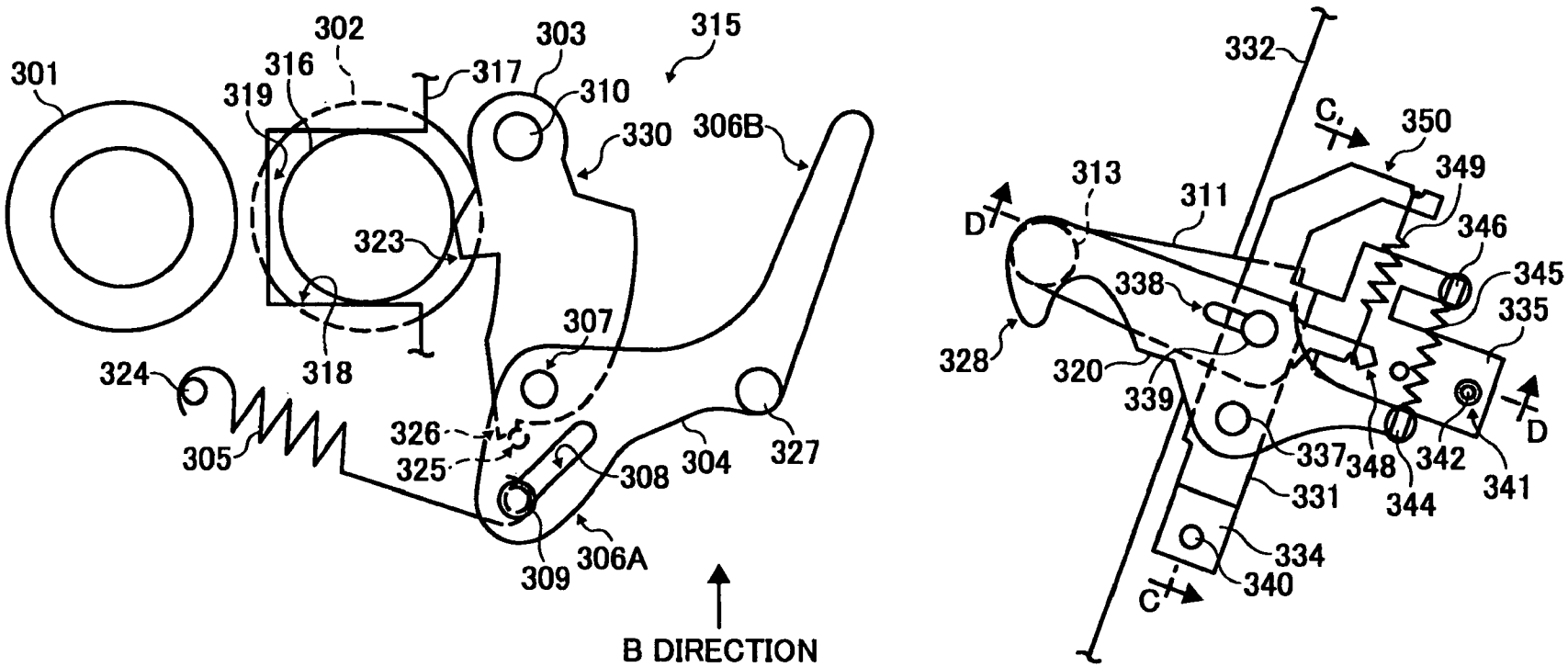
FIG. 8 is a diagram for explaining the pressure-released condition of the fixing device according to a third embodiment.
Figure 9:
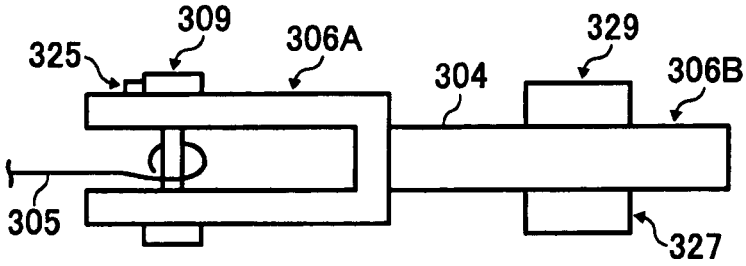
FIG. 9 is a diagram of the fixing device when viewed from a direction B in FIG. 8.
Figure 10:
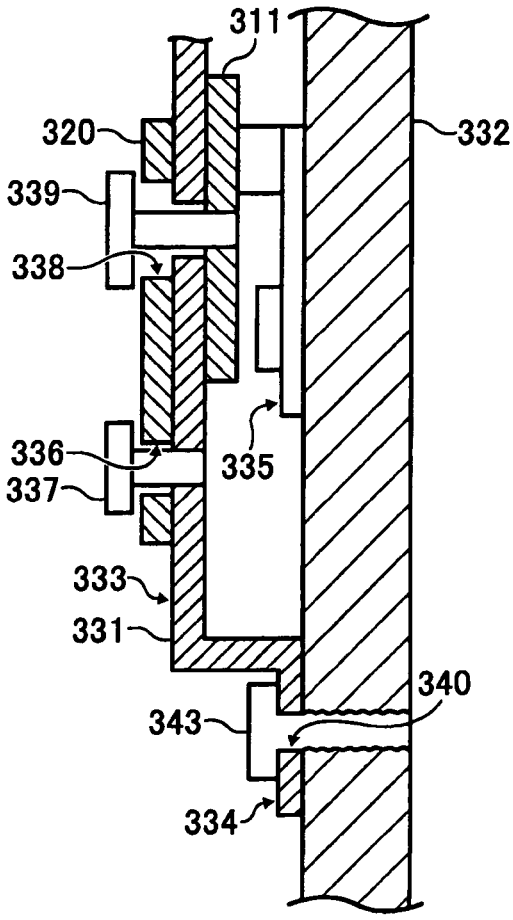
FIG. 10 is a cross-sectional view of the fixing device along the line C-C in FIG. 8.
Figure 11:
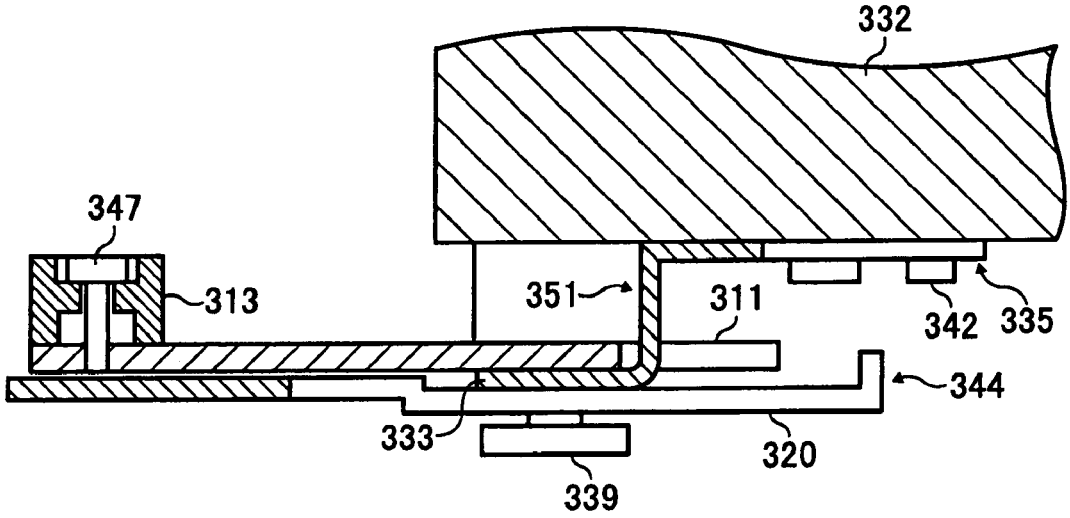
FIG. 11 is a cross-sectional view of the fixing device along the line D-D in FIG. 8.

The pressure mechanism 315 in the fixing device 300 according to a third embodiment is described below. An internal configuration of the image forming apparatus 100 according to the third embodiment is identical to that in the first embodiment. The portions identical to those in the first embodiment are denoted with the same reference numerals and the descriptions of the portions are omitted. At first, the pressure mechanism 315 in the fixing device 300 is described below with reference to FIGS. 8 to 22. FIG. 8 is a diagram for explaining a condition of the pressure mechanism 315 when the side cover 202 is opened widely from the enclosure 200. FIG. 9 is a diagram of the oscillating lever 304 viewed from a direction B in FIG. 8. FIG. 10 is a cross-sectional view of the clamp lever 311 along the line C-C in FIG. 8. FIG. 11 is a cross-sectional view of the clamp lever 311 along the line D-D in FIG. 8.

The pressure mechanism 315 is provided in the front side and the back side (not shown) of the fixing device 300. In the pressure mechanism 315 provided in the front side of the fixing device 300, the bearing 316 in the front side that rotatably supports the pressure roller 302 is pressurized to the fixing roller 301 side. In the pressure mechanism 315 provided in the back side of the fixing device 300, the bearing 316 in the back side that rotatably supports the pressure roller 302 is pressurized to the fixing roller 301 side. When the both bearings 316 are pressurized to the fixing roller 301 side by the pressure mechanism 315, the bearings 316 are guided by an enclosure engaging groove 318 on an enclosure side plate 317 that holds the bearings 316, and contacts an engaging-groove side surface 319 of the enclosure engaging groove 318. And the pressure roller 302 fixed to the bearing 316 pressurizes the fixing roller 301 at a predetermined pressure. The pressure mechanisms 315 provided in the both front and back sides are identical. Therefore, only the pressure mechanism 315 provided in the front side is described below.

The pressure mechanism 315 includes the pressure lever 303 and the oscillating lever 304 as pressurizing units, the clamp lever 311 as a pressing unit, and the release lever 320 as a releasing unit. The pressure lever 303 and the oscillating lever 304 are arranged in the main body of the image forming apparatus. The clamp lever 311 and the release lever 320 are arranged in the side cover 202.

The pressure lever 303 is oscillatably fixed to the rotating shaft 310 as a fixed supporting member that is extended from a side surface of the enclosure 200 or the fixing device 300. The pressure lever 303 includes a pressurizing unit 323 that contacts and pressurizes the bearing 316. In the pressurizing unit 323, when the bearing 316 is pressurized to the fixing roller 301 side, the pressure roller 302 contacts and pressurizes the fixing roller 301. The pressure lever 303 includes the supporting shaft 307, and the oscillating lever 304 is oscillatably attached to the supporting shaft 307.

The oscillating lever 304 is described below with reference to FIGS. 8 and 9. The oscillating lever 304 oscillates between a pressure-released position as shown in FIG. 8 and a pressurizing position. The oscillating lever 304 includes the oscillating edges 306B and 306A. In the pressure-released condition, the oscillating edge 306B extends upward and is inclined toward the side cover 202 side, the oscillating edge 306A is forked at the end of the oscillating edge 306B (see FIG. 9) and is located in the fixing roller 301 side nearer than the oscillating edge 306B. The oscillating edge 306A is oscillatably fixed to the supporting shaft 307 of the pressure lever 303.

Furthermore, the oscillating edge 306A includes the long hole 308, and the latch pin 309 is inserted into the long hole 308. One end of the spring 305 is attached to the latch pin 309, and the other end of the spring 305 is attached to the spring hooking lug 324 extended from a side surface of the enclosure 200 or the fixing device 300. While the oscillating lever 304 oscillates from the pressure-released position to the pressurizing position, the long hole 308, the latch pin 309, and the spring 305 serve as bias switching units such that the bias force of the spring 305 towards the oscillating lever 304 is switched from a direction biasing to the pressure-released position (in a clockwise direction) to a direction biasing to the pressurizing position (in a counterclockwise direction). When the side cover 202 is opened widely from the enclosure 200 (the oscillating lever 304 is at the pressure-released position), the spring 305 is in a free length as shown in FIG. 8.

A striking pin 325 is arranged on the back side of a side surface of the oscillating edge 306A. When the oscillating lever 304 is at the pressure-released position, the striking pin 325 strikes on a striking unit 326 of the pressure lever 303, and the oscillating lever 304 is restricted to an oscillation in the clockwise direction. An engaging lug 327 is arranged on the front side of a side surface of the oscillating edge 306B. When the oscillating lever 304 is released to pressurize, the engaging lug 327 is engaged with the hook unit 328 of the release lever 320. A striking lug 329 is located facing to the engaging lug 327 on back side of the side surface of the oscillating edge 306B. When the pressure mechanism 315 is in the pressurizing condition, the striking lug 329 strikes on a striking groove unit 330 of the pressure lever 303, and the pressure lever 303 is restricted to a rotation in the counterclockwise direction (to the pressure-released position).

The striking pins 325 are arranged on the both sides of the oscillating lever 304. The engaging lug 327 and the striking lug 329 have same shape. Therefore, both of the pressure mechanisms 315 in the front and back sides can share the oscillating lever 304. Thus, costs of the device can be reduced.

A positioning lug 342 extended from a duplex-unit side plate 332 is inserted into a second-fixed-unit positioning hole 341 arranged on a second fixed unit 335, and a bracket 331, where the clamp lever 311 and the release lever 320 are fixed, is positioned.

As shown in FIG. 8, the hook-like hook unit 328 is arranged on the end of the release lever 320 in the main body of the image forming apparatus 100 side. When the pressurizing condition of the pressure mechanism 315 is released, the hook unit 328 is engaged with the engaging lug 327 of the oscillating lever 304. A release-spring attached unit 344 jutted into the front side is arranged on the end of the release lever 320 in the duplex unit 201 side, and one end of a release spring 345 is attached to the release-spring attached unit 344. The other end of the release spring 345 is expanded and attached to a second spring attached unit 346 arranged on the second fixed unit 335. The release lever 320 is biased in a counterclockwise direction by the release spring 345. Furthermore, a second fixing pin 339 is inserted into a release-lever long hole unit 338 of the release lever 320 and a hole unit of the bracket 331, and fixed to the clamp lever 311. Therefore, the release lever 320 is restricted to a rotation in the counterclockwise direction.

As shown in FIG. 8, a clamp spring attached unit 348 is arranged on the end of the duplex-unit side plate 332 in the clamp lever 311, and one end of a clamp spring 349 is attached to the clamp spring attached unit 348. The other end of the clamp spring 349 is expanded and attached to a first spring attached unit 350 extended from a tiered unit 333 of the bracket 331. Therefore, the clamp lever 311 is biased in the counterclockwise direction.

The clamp lever 311 and the release lever 320 are described below with reference to FIGS. 10 and 11. The clamp lever 311 and the release lever 320 are fixed to the duplex-unit side plate 332 of the duplex unit 201 in the side cover 202 via the bracket 331. The bracket 331 includes the tiered unit 333 that hovers on the duplex-unit side plate 332, a first fixed unit 334, and the second fixed unit 335. The release lever 320 includes a release-lever hole unit 336, and a first fixing pin 337 is inserted into the release-lever hole unit 336 and fixed to the tiered unit 333 of the bracket 331 by caulking.

The release lever 320 is oscillatably fixed to the bracket 331, and oscillates centering around the first fixing pin 337. The second fixing pin 339 is inserted into the release-lever long hole unit 338 of the release lever 320, and passes through the tiered unit 333 of the bracket 331, and then fixed to the clamp lever 311 by caulking. The clamp lever 311 is oscillatably fixed to the bracket 331, and oscillates centering around the second fixing pin 339. Furthermore, a fixing screw 343 is screwed into a first-fixed-unit screw hole 340 in the first fixed unit 334, and the bracket 331 is fixed to the duplex-unit side plate 332.

As shown in FIG. 11, the press roller 313 is rotatably attached to the end of the clamp lever 311 in the enclosure 200 side via an engaging pin 347. The release lever 320, the tiered unit 333, and the bracket 331 are oscillatably fixed by the second fixing pin 339 in the order of the far side from the duplex-unit side plate 332 and oscillate centering around the second fixing pin 339. The release lever 320 includes the release-spring attached unit 344. In the pressure-released condition, when the clamp lever 311 strikes on a connecting unit 351 of the bracket 331 and the press roller 313 contacts the oscillating lever 304, a position of the clamp lever 311 is restricted to a position where the press roller 313 can contact the oscillating edge 306B. Furthermore, the second fixed unit 335 is fixed to the duplex-unit side plate 332 by the positioning lug 342.

The pressure mechanism 315 pressurizes the bearing 316 of the pressure roller 302 while the side cover 202 opened widely from the enclosure 200 (see FIG. 8) is getting closed. The situation is described below with reference to FIGS. 12 to 20. The portions identical to those in FIG. 8 are denoted with the same reference numerals and the descriptions of the portions are omitted.

Figure 12:
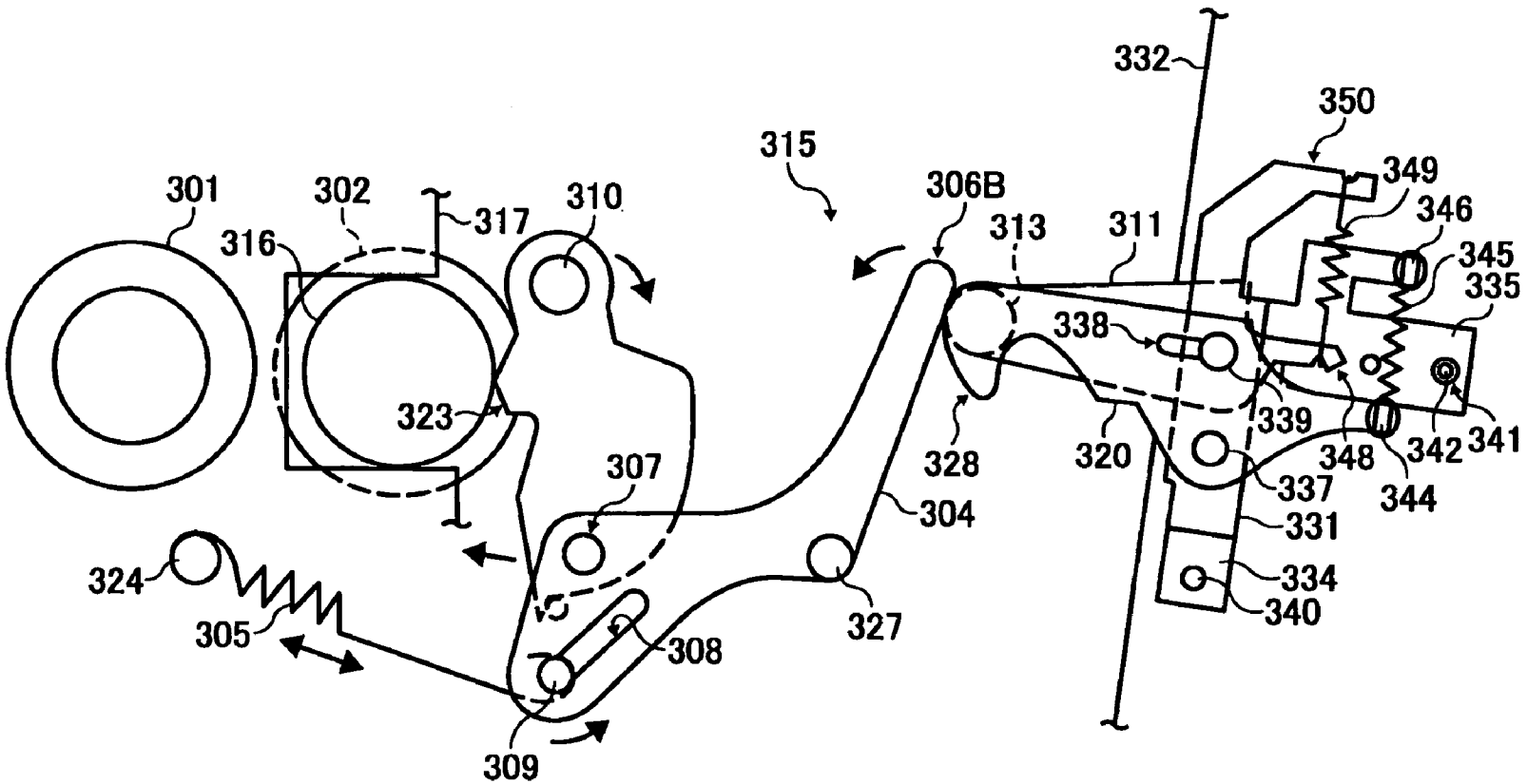
FIG. 12 is a diagram of the fixing device according to the third embodiment when a clamp lever contacts an oscillating lever.

When a paper jam occurs in the post-transfer sheet conveying path 413 or the sheet path from the fixing device 300 to outside, the side cover 202 is opened, and the jammed paper sheet is removed. When the side cover 202 is getting closed after fixing the paper jam, the press roller 313 included in the clamp lever 311 contacts the oscillating edge 306B of the oscillating lever 304 as shown in FIG. 12.

Figure 13:
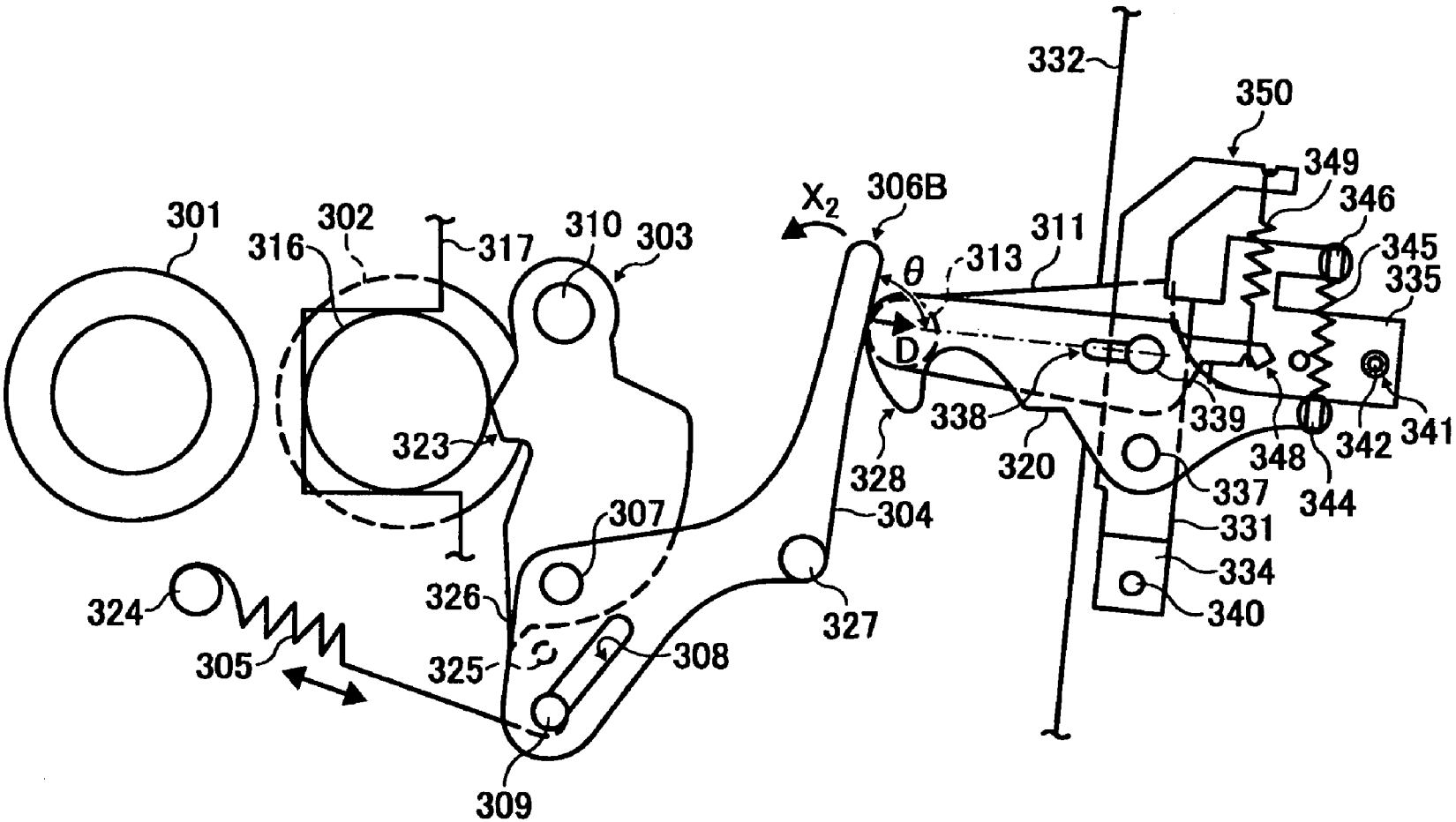
FIG. 13 is a diagram of the fixing device according to the third embodiment when the oscillating lever pressurizes the clamp lever.

When the side cover 202 is further getting closed, the oscillating lever 304 is pressed by the clamp lever 311 and oscillates in the counterclockwise direction (the pressurizing direction) centering around the supporting shaft 307 as shown in FIG. 13. A pressing force of the clamp lever 311 to the fixing roller 301 side is transmitted to the supporting shaft 307 via the oscillating lever 304, and the pressure lever 303 is oscillated in the clockwise direction centering around the rotating shaft 310. Then, the pressurizing unit 323 of the pressure lever 303 presses the bearing 316 of the pressure roller 302 to move to the fixing roller 301 side.

When the oscillating lever 304 oscillates in the counterclockwise direction $X_2$ (the pressurizing direction) centering around the supporting shaft 307, the latch pin 309 of the oscillating lever 304 moves away from the spring hooking lug 324. As a result, the spring 305 being in the free length is expanded, and biases the oscillating lever 304 in the clockwise direction (in a direction to the pressure-released position) via the latch pin 309.

At this time, when viewed from a cross-unit of the fixing roller 301 in the axial direction as shown in FIG. 13, an angle θ between a line connecting a contact point between the press roller 313 and the oscillating edge 306B with a center point of the second fixing pin 339 where the clamp lever 311 oscillate around as a supporting point and a side surface of the oscillating edge 306B that contacts the clamp lever 311 of the oscillating lever 304 is less than 90 degrees. Therefore, the oscillating lever 304 receives a force D in an obliquely downward direction from the clamp lever 311.

Figure 14:
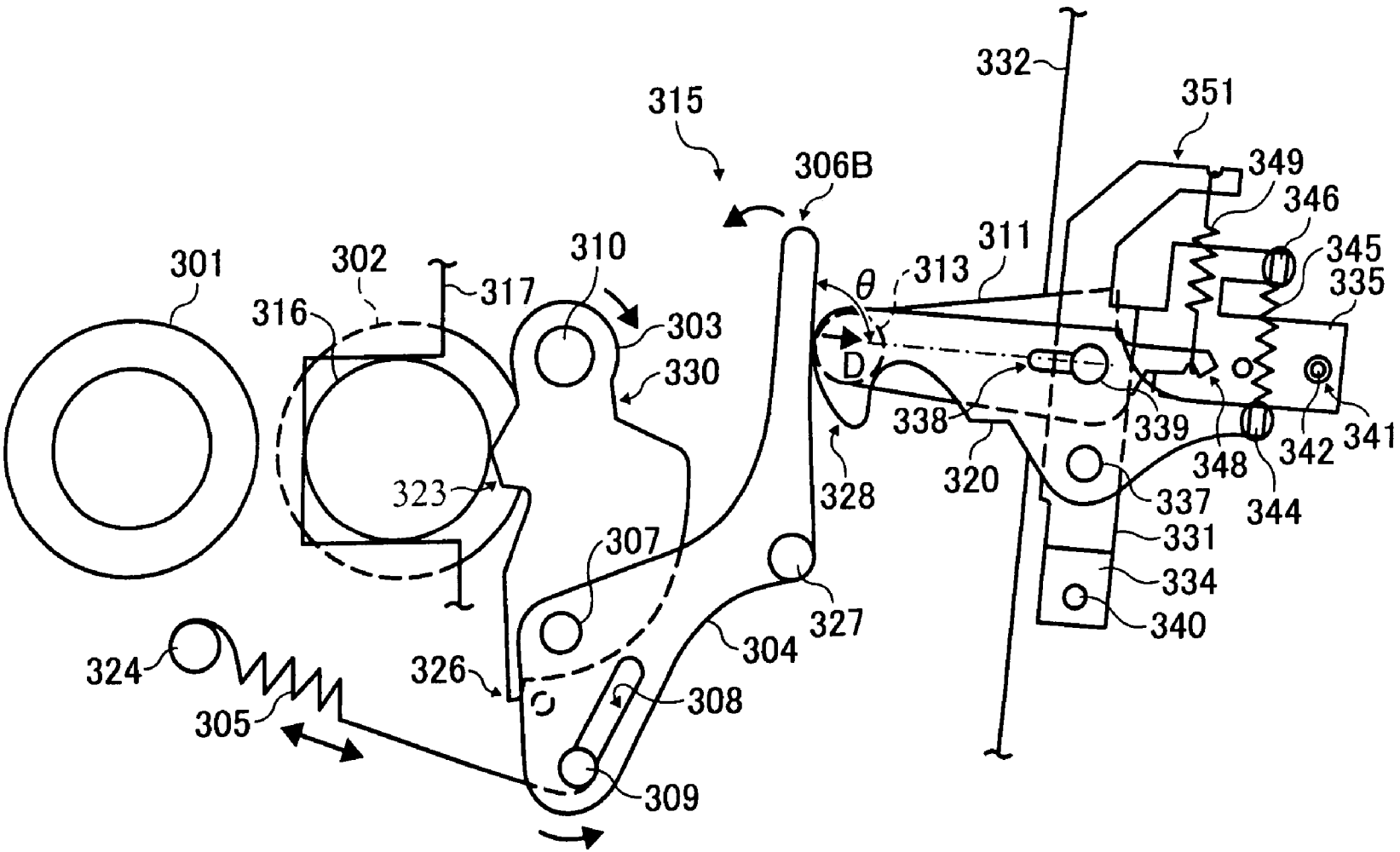
FIG. 14 is a diagram of the fixing device according to the third embodiment when the oscillating lever pressurizes the clamp lever more than in a case of FIG. 13.
Figure 15:
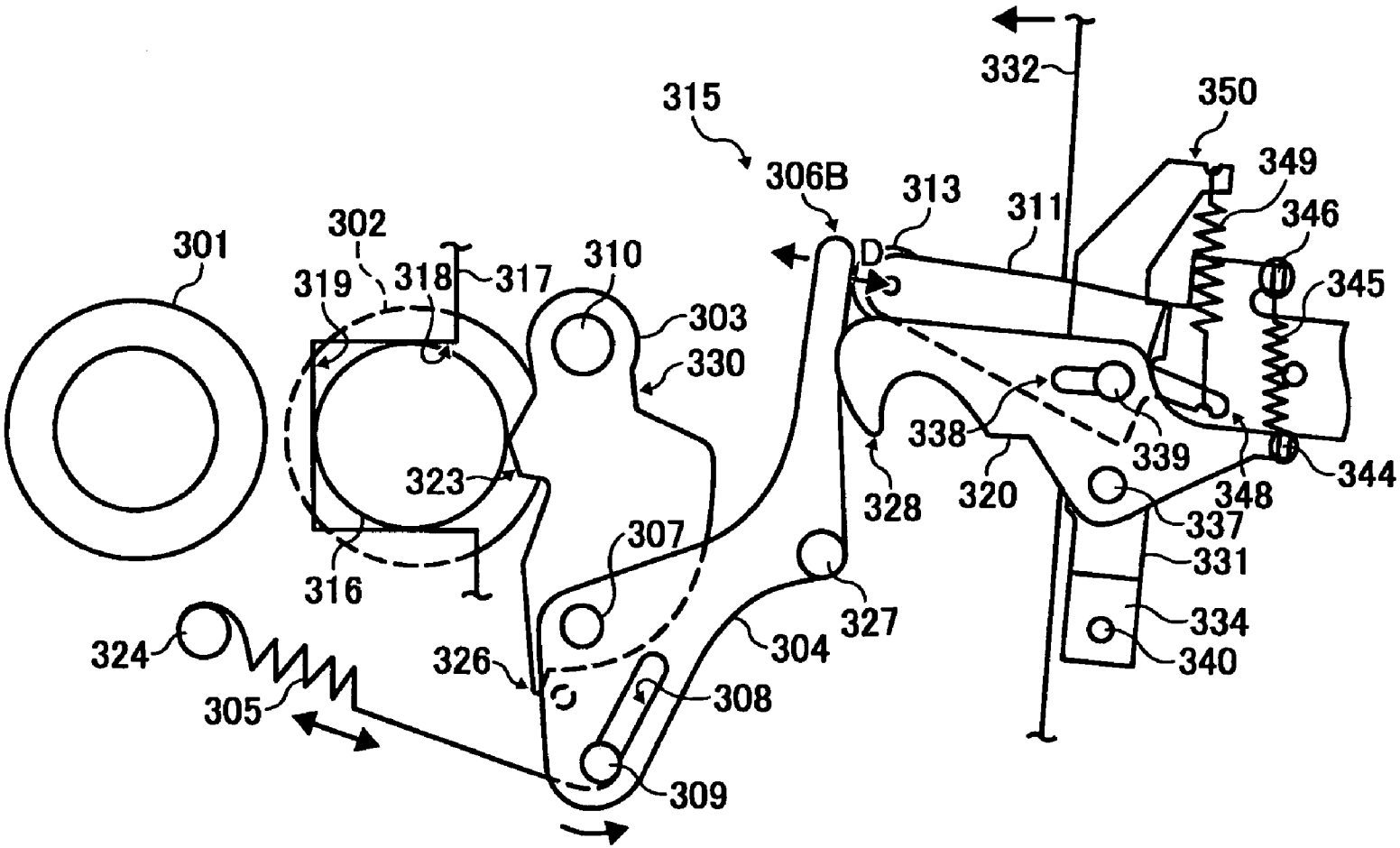
FIG. 15 is a diagram of the fixing device according to the third embodiment when the oscillating lever pressurizes the clamp lever more than in a case of FIG. 14.

As shown in FIG. 14, the press roller 313 included in the clamp lever 311 receives the force D in the obliquely downward direction from the oscillating lever 304 until the angle θ becomes 90 degrees, and the side surface of the oscillating edge 306B is moved downward. The press roller 313 is rotatably attached to the clamp lever 311, so that the press roller 313 rotates and smoothly moves downward on the side surface of the oscillating edge 306B. Therefore, a resistance at closing the side cover 202 is decreased, and the side cover 202 is closed smoothly. When the oscillating lever 304 is pressed by the clamp lever 311 and oscillates in the counterclockwise direction (the pressurizing direction), the latch pin 309 is farther moved away from the spring hooking lug 324, and the spring 305 is expanded more. Therefore, a force (moment) that the spring 305 makes the oscillating lever 304 oscillate in the counterclockwise direction is increased, and a force to press the clamp lever 311 downward is also increased.

When the oscillating lever 304 is pressed more than the state as shown in FIG. 14 such that the angle θ becomes more than 90 degrees, the center of the press roller 313 is located above the contact position between the press roller 313 and the oscillating edge 306B. A direction of the moment acting on the clamp lever 311 from the oscillating lever 304 is switched from a direction to press the clamp lever 311 downward to a direction to lift the clamp lever 311 upward. As a result, the moment to lift the clamp lever 311 upward surpasses the moment to bias the clamp lever 311 in the counterclockwise direction by the clamp spring 349. Therefore, the clamp lever 311 oscillates in the clockwise direction.

As a result, the press roller 313 moves away from the supporting shaft 307 of the oscillating lever 304. In other words, the clamp lever 311 is displaced from a first position where an end of the clamp lever 311 in the fixing roller 301 side and an end of the release lever 320 in the fixing roller 301 side are aligned in a vertical direction to a second position where the end of the clamp lever 311 is located above the end of the release lever 320 (see FIG. 15).

Therefore, a position where the clamp lever 311 presses the oscillating lever 304 is moved away from the supporting shaft 307 of the oscillating lever 304. Therefore, the oscillating lever 304 can rotate with the less force. Thus, the resistance at closing the side cover 202 to the enclosure 200 can be reduced, and the side cover 202 can be closed smoothly. At this time, the clamp lever 311 contacts a side surface of a connecting unit 353 of the bracket 331. Therefore, the clamp lever 311 is restricted to an oscillation in the clockwise direction. In the condition above, the striking lug 329 (not shown) of the oscillating lever 304 contacts the striking groove unit 330 of the pressure lever 303.

Figure 16:
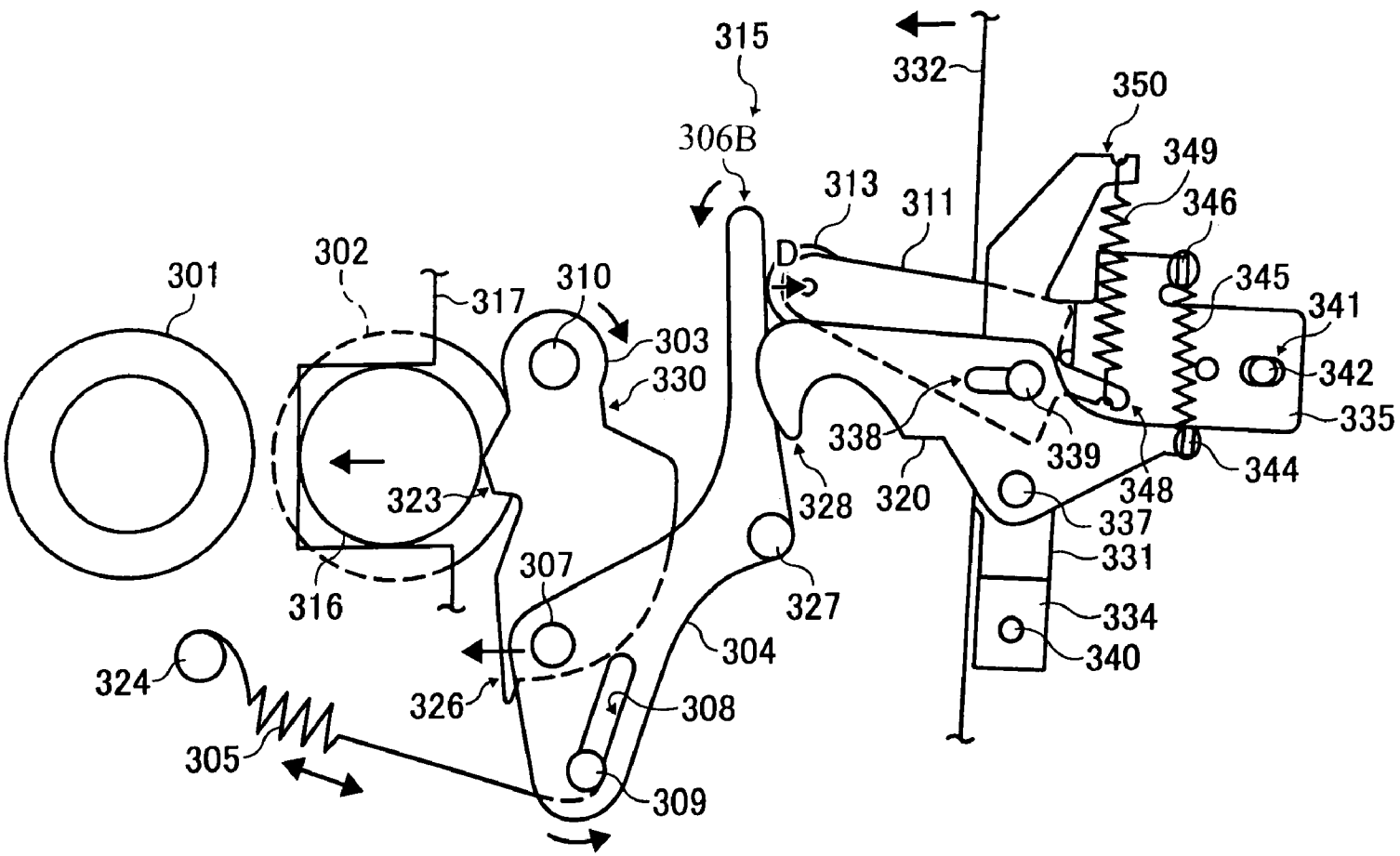
FIG. 16 is a diagram of the fixing device according to the third embodiment when the oscillating lever pressurizes the clamp lever more than in a case of FIG. 15.
Figure 17:
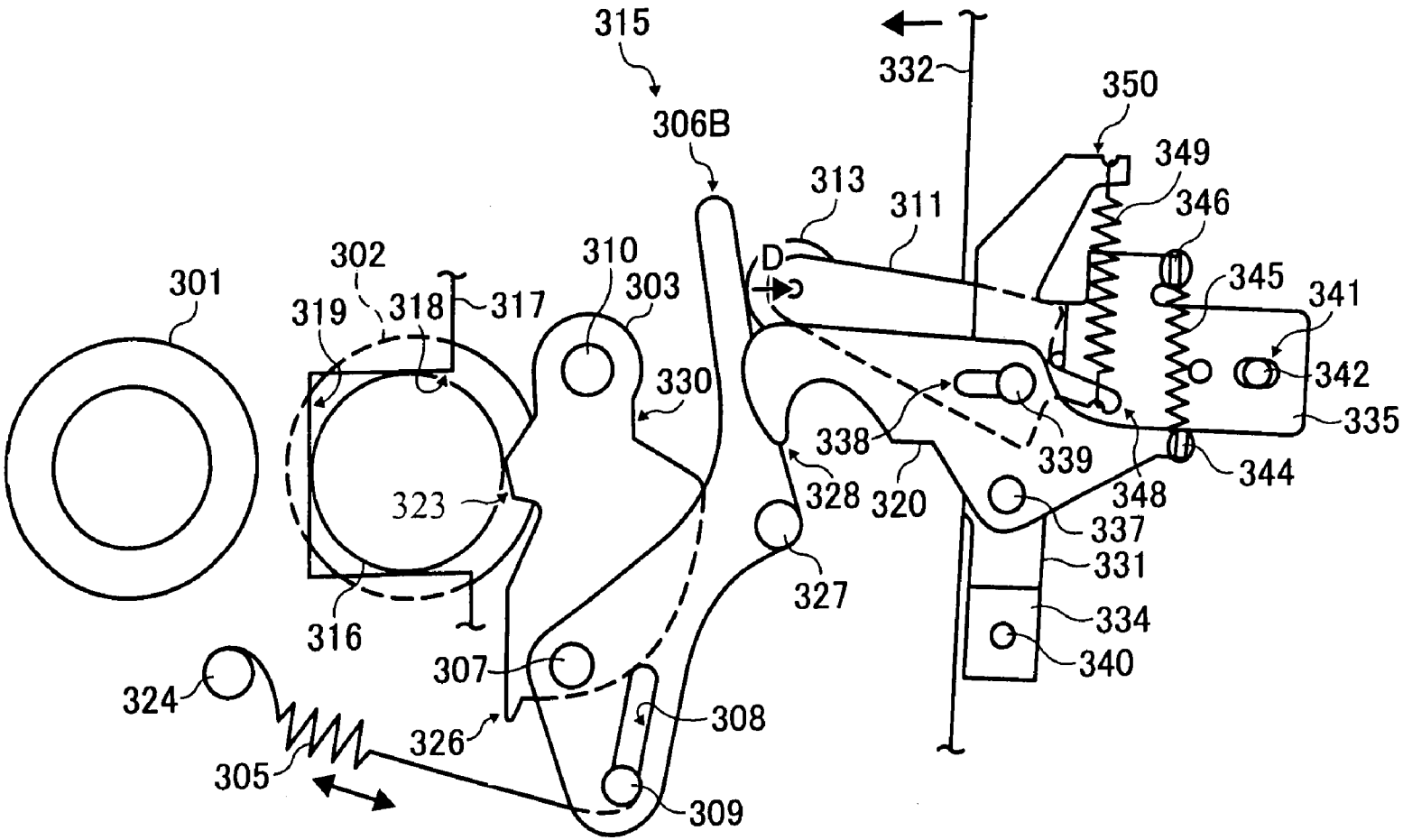
FIG. 17 is a diagram of the fixing device according to the third embodiment when the oscillating lever pressurizes the clamp lever more than in a case of FIG. 16.

When the side cover 202 is further getting closed, as shown in FIGS. 16 and 17, the press roller 313 rotates and moves from on the end of the oscillating edge 306B to downward. The oscillating lever 304 is pressed by the clamp lever 311 and rotates in the counterclockwise direction. Therefore, the long hole 308 of the oscillating lever 304, which is inclined obliquely upward from the fixing roller 301 side to the side cover 202 side, is getting risen. Under the condition as shown in FIG. 17, the bias force of the spring 305 becomes maximum, and the moment to oscillate the oscillating lever 304 in the counterclockwise direction (to the pressure-released position) is also maximum. Furthermore, a supporting point where the oscillating lever 304 oscillates in the clockwise direction (to the pressurizing point) is sufficiently away from the supporting shaft 307 of the oscillating lever 304, so that the resistance at closing the side cover 202 is not increased more than necessary.

Figure 18:
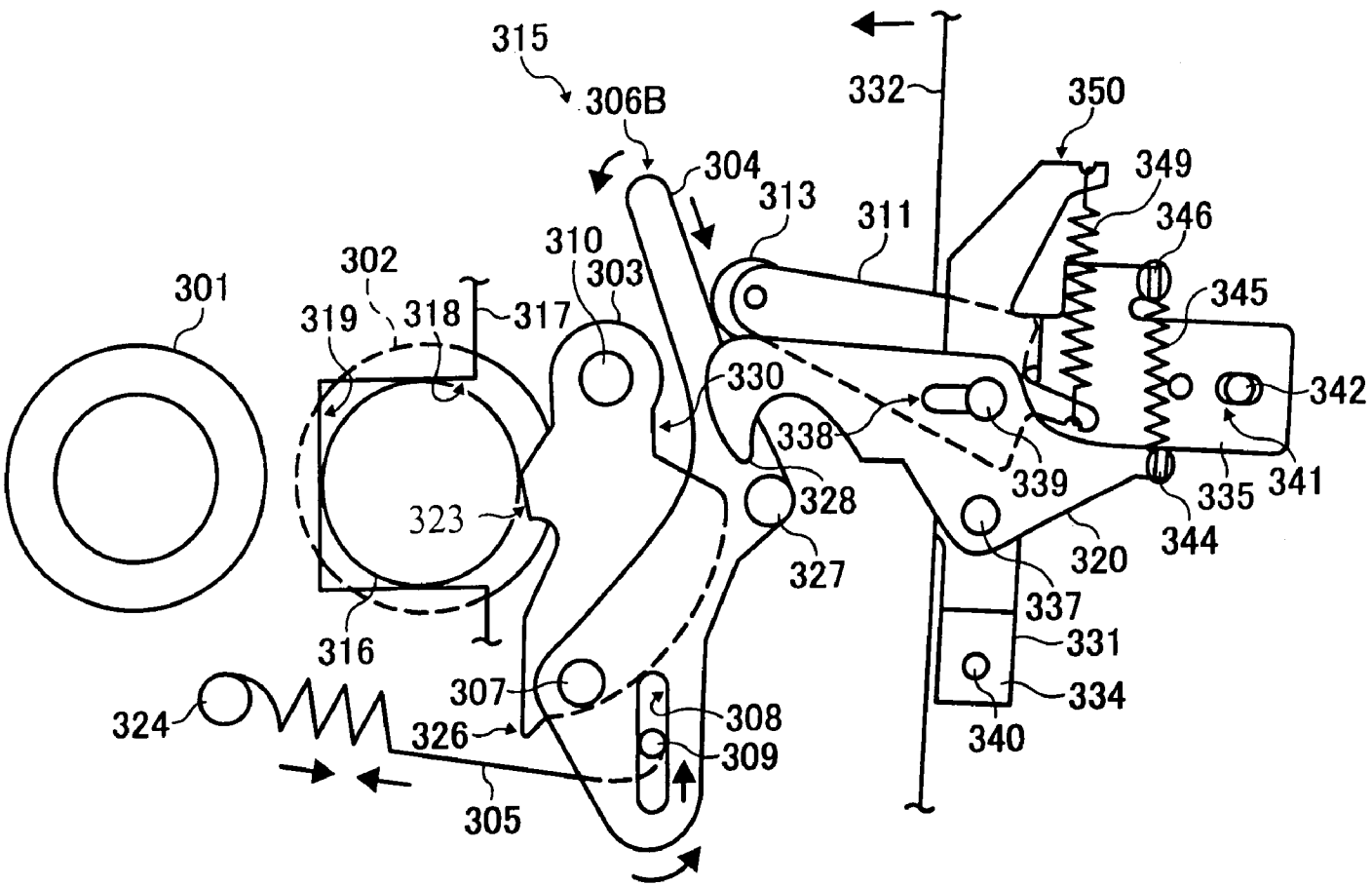
FIG. 18 is a diagram of the fixing device according to the third embodiment when the oscillating lever pressurizes the clamp lever more than in a case of FIG. 17.

As shown in FIG. 18, when the long hole 308 of the oscillating lever 304 rises vertically, the latch pin 309 engaged with the long hole 308 moves from the lower end to the superior end in the long hole 308 by the bias force of the spring 305.

Figure 19:
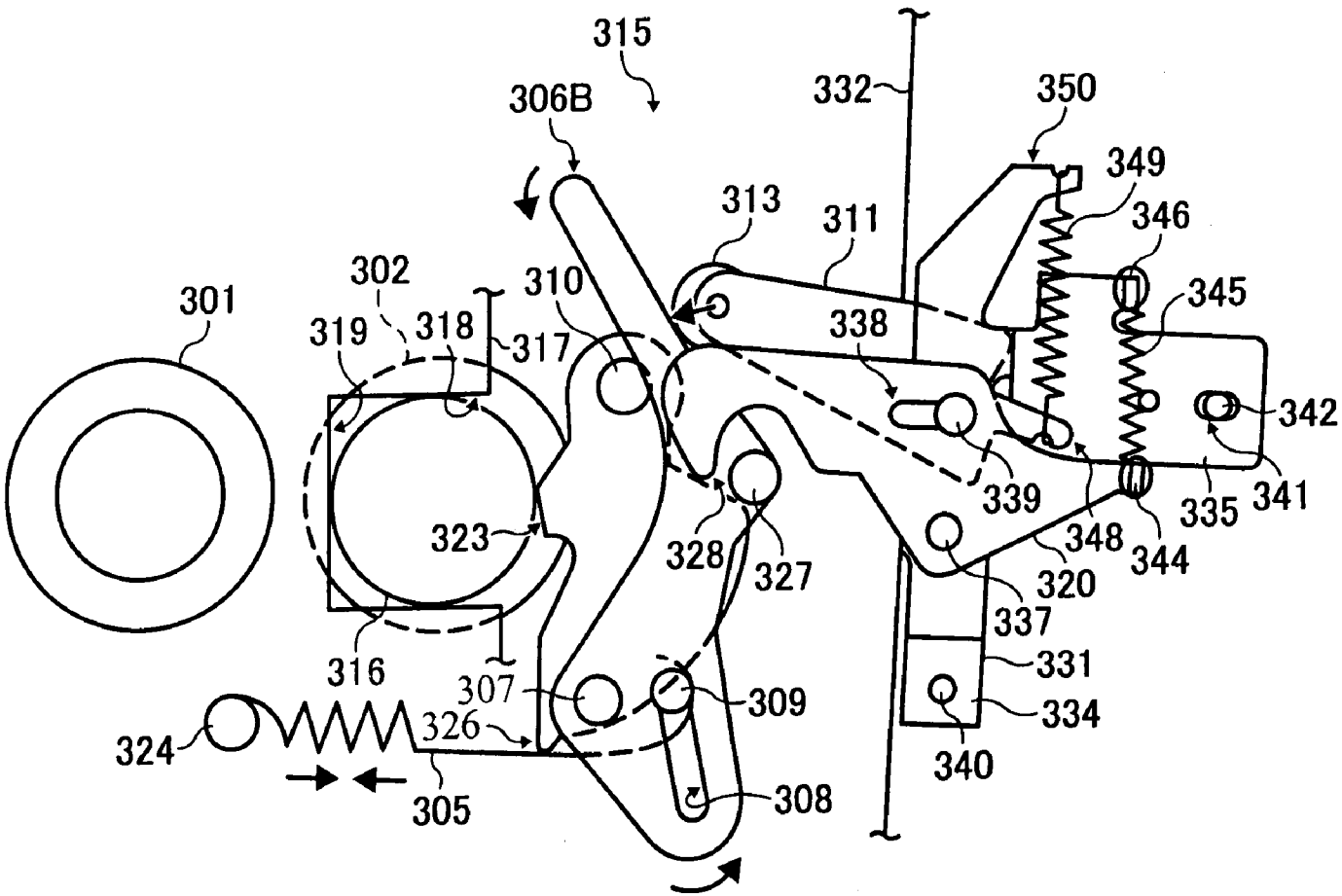
FIG. 19 is a diagram of the fixing device according to the third embodiment when the oscillating lever pressurizes the clamp lever more than in a case of FIG. 18.

When the oscillating lever 304 is further oscillated in the counterclockwise direction by the clamp lever 311 as shown in FIG. 19, a distance between the superior end of the long hole 308 and the spring hooking lug 324 is shorter than a distance between the lower end of the long hole 308 and the spring hooking lug 324. In the result, the latch pin 309 moves to the superior end of the long hole 308. When the latch pin 309 moves to the superior end of the long hole 308, a center shaft of the latch pin 309 is located above the supporting shaft 307 of the oscillating lever 304.

As a result, the bias force of the spring 305 is switched from the moment to oscillate the oscillating lever 304 in the clockwise direction (the pressure-released direction) to the moment to oscillate the oscillating lever 304 in the counterclockwise direction (the pressurizing direction). Therefore, the moment that the oscillating lever 304 presses the clamp lever 311 upward disappears, but the moment that the clamp lever 311 presses the oscillating lever 304 downwards by the bias force of the spring 305 contrary appears. Therefore, the oscillating lever 304 is oscillated in the counterclockwise direction (to the pressurizing position) smoothly by the moment that the clamp lever 311 presses the oscillating lever 304 downwards and the moment that the spring 305 makes the oscillating lever 304 rotate in the counterclockwise direction. Thus, the resistance at closing the side cover 202 to the enclosure 200 can be reduced, so that the side cover 202 can be closed smoothly.

Figure 20:
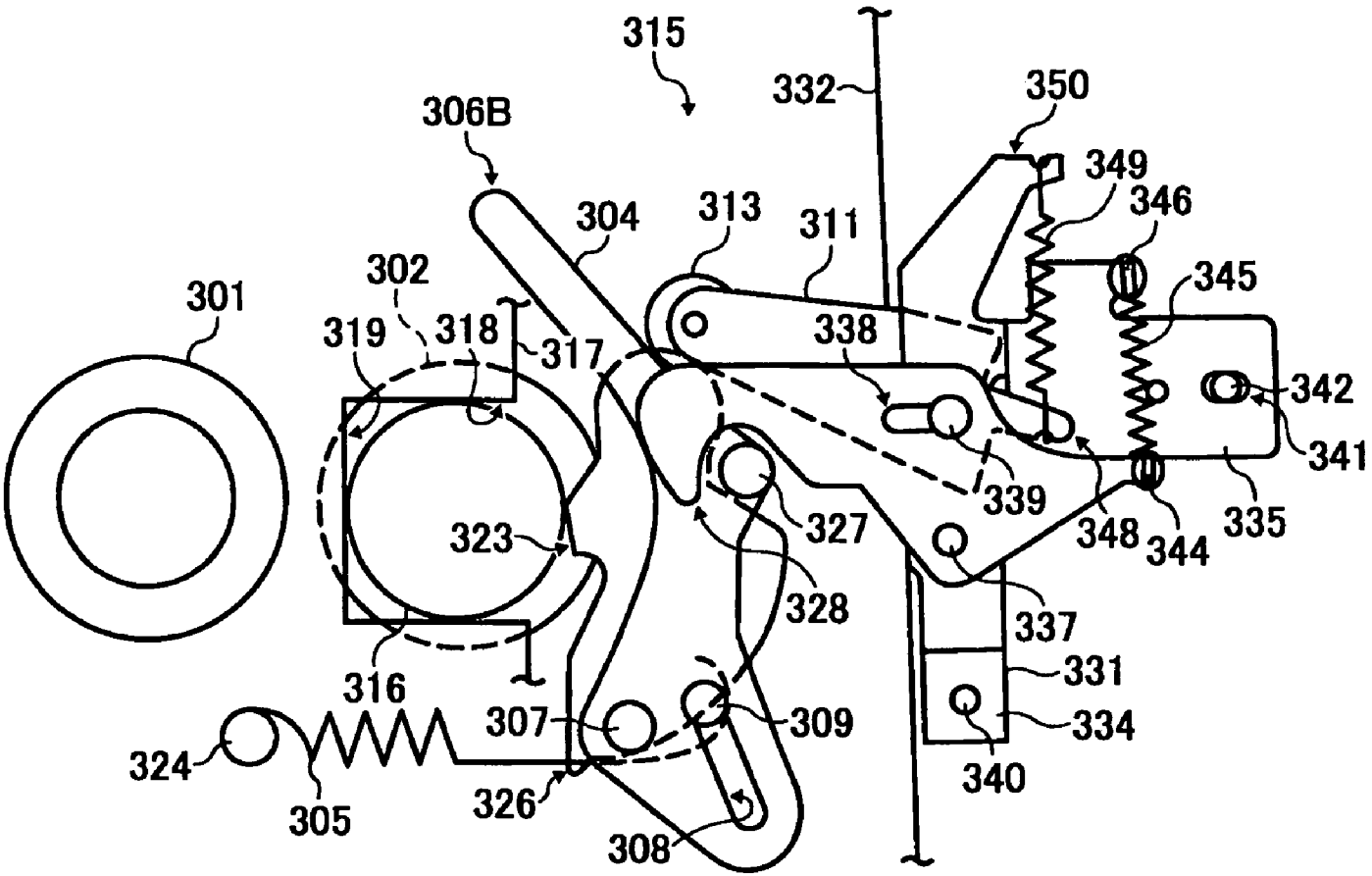
FIG. 20 is a diagram for explaining the pressurizing condition of the fixing device according to the third embodiment.

As shown in FIG. 20, when the side cover 202 is closed, the striking lug 329 (see FIG. 9) in the oscillating lever 304 strikes on the striking groove unit 330 in the pressure lever 303. Furthermore, the spring 305 biases the oscillating lever 304 to the pressure roller 302 side, and the supporting shaft 307 is also biased to the pressure roller 302 side. At the time, a moment acts on the pressure lever 303 to rotate in the clockwise direction, so that the bearing 316 is pressurized sufficiently. The clamp lever 311 presses the oscillating lever 304 downwards by the bias force of the spring 305, so that the oscillating lever 304 is restricted to a rotation in the clockwise direction.

The oscillating lever 304 is restricted to a movement by the clamp lever 311, so that the striking lug 329 of the oscillating lever 304 receives a reaction force from the bearing 316, and the pressure lever 303 is restricted to a rotation in the counterclockwise. Therefore, the pressure mechanism 315 can pressurizes the bearing 316 at a predetermined pressure. When the side cover 202 is closed (the pressure mechanism is in the pressurizing condition), the engaging lug 327 of the oscillating lever 304 is located closer to the side cover 202 side than the hook unit 328 in the release lever 320 and faces against the side cover 202.

When the side cover 202 is opened, the hook unit 328 in the release lever 320 is engaged with the engaging lug 327 of the oscillating lever 304, and the oscillating lever 304 is rotated in the clockwise direction. The release lever 320 is biased in the counterclockwise direction by the release spring 345. Therefore, when the hook unit 328 contacts the engaging lug 327, the release lever 320 does not move over the engaging lug 327, and is engaged with the engaging lug 327 certainly. When the oscillating lever 304 is rotated in the clockwise direction at the hook unit 328, the hook unit 328 moves away from the engaging lug 327.

Furthermore, when the hook unit 328 moves away from the engaging lug 327, the lower end of the long hole 308 is closer to the fixing roller 301 side than the superior end of the long hole 308. Therefore, the latch pin 309 moves from the superior end to the lower end in the long hole 308. And the moment that the bias force of the spring 305 makes the oscillating lever 304 rotate in the counterclockwise direction is changed to the moment that the oscillating lever 304 is rotated in the clockwise direction. Thus, even though the engaging lug 327 moves away from the hook unit 328, the oscillating lever 304 is rotated in the clockwise direction by the bias force of the spring 305, and contacts the clamp lever 311. And then, the oscillating lever 304 strikes on the press roller 313 of the clamp lever 311, and oscillates to the pressure-released position (see FIG. 8) gradually.

As described above, while the oscillating lever 304 is pressed by the clamp lever 311 and oscillated from the pressure-released position to the pressurizing position, the clamp lever 311 oscillates and moves onto the tip of the oscillating lever 304. While the oscillating lever 304 is pressed by the clamp lever 311 and oscillated from the pressure-released position to the pressurizing position, a distance between a supporting point where the oscillating lever 304 is oscillated and a supporting point where the clamp lever 311 presses the oscillating lever 304 is controlled to prevent from getting shorter as compared with in the case of being the clamp lever 311 non-oscillatable. Therefore, the clamp lever 311 can reduce a force required to pressing the oscillating lever 304 to the pressurizing position. In the result, even though the clamp lever 311 does not press the oscillating lever 304 so hard, the oscillating lever 304 can be oscillated to the pressurizing position, and the resistance at closing the side cover 202 can be reduced.

While the oscillating lever 304 oscillates the pressure-released position to the pressurizing position, the moment that the press roller 313 receives from the oscillating lever 304 is switched from in a direction pressing down the clamp lever 311 (in a direction approaching the supporting shaft of the oscillating lever 304) to in a direction lifting up the clamp lever 311 (in a direction moving away from the supporting shaft of the oscillating lever 304). More specifically, when viewed from a cross-unit of the fixing roller 301 in the axial direction, a direction of the moment that the clamp lever 311 receives from the oscillating lever 304 is switched on reaching a point that the angle θ between a contact surface (a side surface) of the oscillating lever 304 with the clamp lever 311 and a line connecting a connecting point between the clamp lever 311 and the oscillating lever 304 with a supporting point of the clamp lever 311 becomes 90 degrees. When the angle θ is less than 90 degrees, the clamp lever 311 receives the moment in the direction being pressed down (in the direction approaching the supporting shaft of the oscillating lever 304) from the oscillating lever 304 because of the bias force of the spring 305 that biases the oscillating lever 304 to the pressure-released position. When the angle θ is more than 90 degrees, the clamp lever 311 receives the moment in the direction being pushed up (in the direction moving away from the supporting shaft of the oscillating lever 304) from the oscillating lever 304 because of the bias force of the spring 305 that biases the oscillating lever 304 to the pressure-released position. Therefore, the moment that the clamp lever 311 receives from the oscillating lever 304 is switched while the oscillating lever 304 oscillates from the pressure-released position to the pressurizing position. The moment is switched to in the direction pushing up the clamp lever 311 (in the direction moving away from the supporting shaft of the oscillating lever 304), so that the clamp lever 311 moves towards the front edge of the oscillating lever 304. Thus, while the oscillating lever 304 oscillates from the pressure-released position to the pressurizing position, the supporting point that the clamp lever 311 pushes the oscillating lever 304 (the contact point between the clamp lever 311 and the oscillating lever 304) can be moved away from the supporting point (supporting shaft) that the oscillating lever 304 oscillates centering around.

The clamp spring 349 is attached to the clamp lever 311. The clamp spring 349 biases the clamp lever 311 in the direction that the clamp lever 311 is pushed down to the oscillating lever 304 side (in the direction approaching the supporting shaft of the oscillating lever 304). When the pressure mechanism 315 is in the pressurizing condition, the clamp spring 349 biases the oscillating lever 304 via the clamp lever 311, so that the oscillating lever 304 is prevented from oscillating to the pressure-released position. When the pressure mechanism 315 is in the pressure-released condition, the oscillating lever 304 can oscillate back to the predetermined position. When the oscillating lever 304 oscillates from the pressure-released position to the pressurizing position, the press roller 313 can surely contact the front edge of the oscillating lever 304.

The rotatable press roller 313 in the clamp lever 311 contacts the oscillating lever 304. Therefore, when the oscillating lever 304 oscillates from the pressure-released position to the pressurizing position, the clamp lever 311 can move smoothly on the side surface of the oscillating lever 304 because of a rotation of the press roller 313. In the result, a sliding resistance to the oscillating lever 304 can be reduced, and the side cover 202 can be closed smoothly. Furthermore, a wear of the oscillating lever 304 can decrease.

In the irregular state such that the oscillating lever 304 is in the pressurizing position even though the side cover 202 is opened, when the side cover 202 is closed, the release lever 320 strikes on the engaging lug 327. The release lever 320 is oscillatably, so that the release lever 320 oscillates so as to get over the engaging lug 327. Therefore, even though the oscillating lever 304 is in the pressurizing position when the side cover 202 is opened, the side cover 202 can be closed properly.

The release lever 320 includes an inclined surface in the front edge that is near the pressure roller 302 side. When the release lever 320 strikes on the engaging lug 327, and the side cover 202 is closed, the release lever 320 oscillates upward along the inclined surface. Therefore, the release lever 320 can get over the engaging lug 327 smoothly. Thus, even though the pressure mechanism 315 is in the irregular state, a resistance to closing the side cover 202 can be reduced.

The release lever 320 is biased in the counterclockwise direction (in the opposite direction to an oscillating direction when the release lever 320 strikes on the engaging lug 327) by the release spring 345. Therefore, after getting over the engaging lug 327, the release lever 320 can be positioned such that the hook unit 328 in the release lever 320 can engage with the engaging lug 327.

Figure 21:
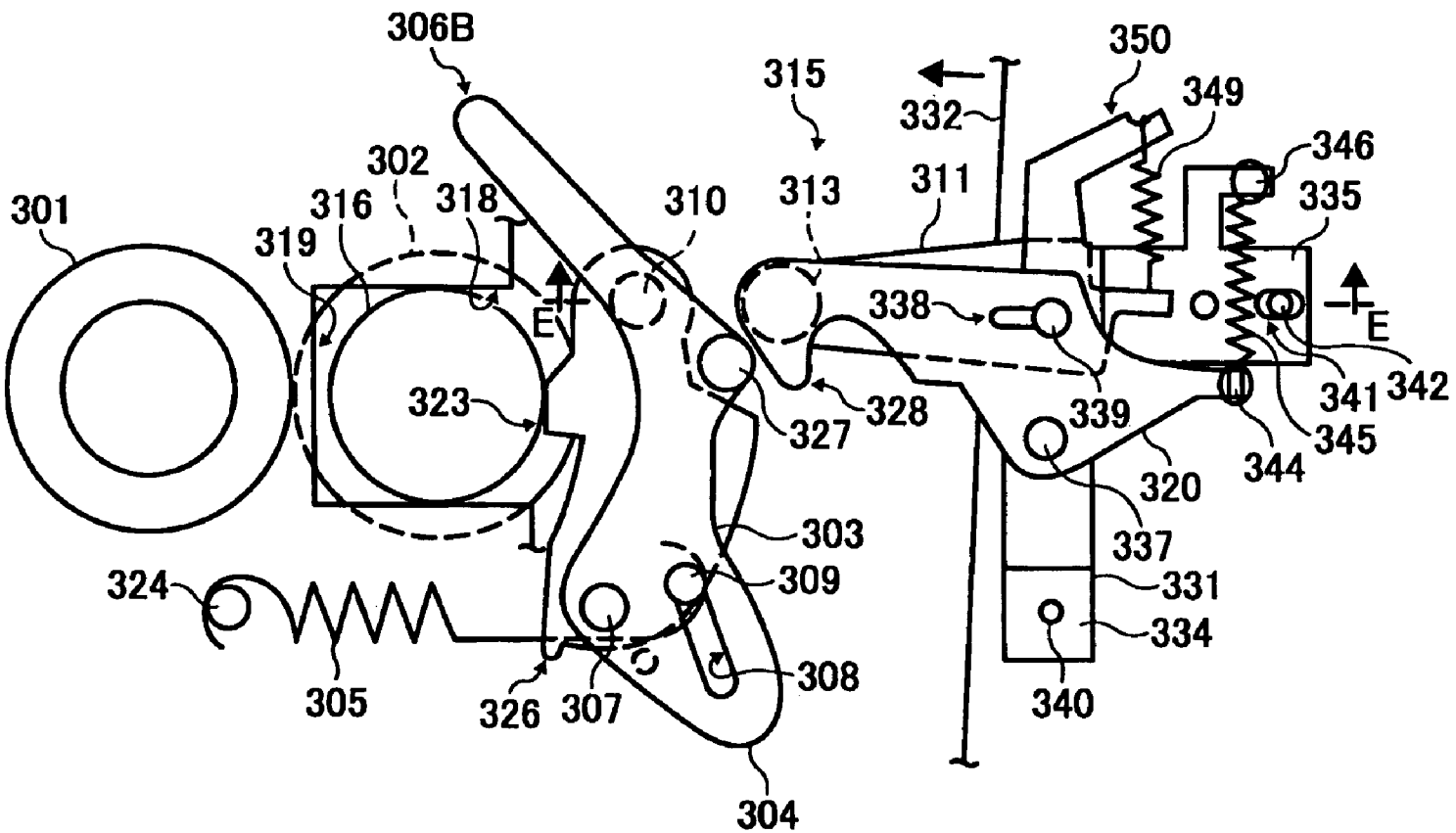
FIG. 21 is a diagram for explaining the irregular pressurizing condition of the fixing device according to the third embodiment when the side cover of the image forming apparatus is opened.
Figure 22:
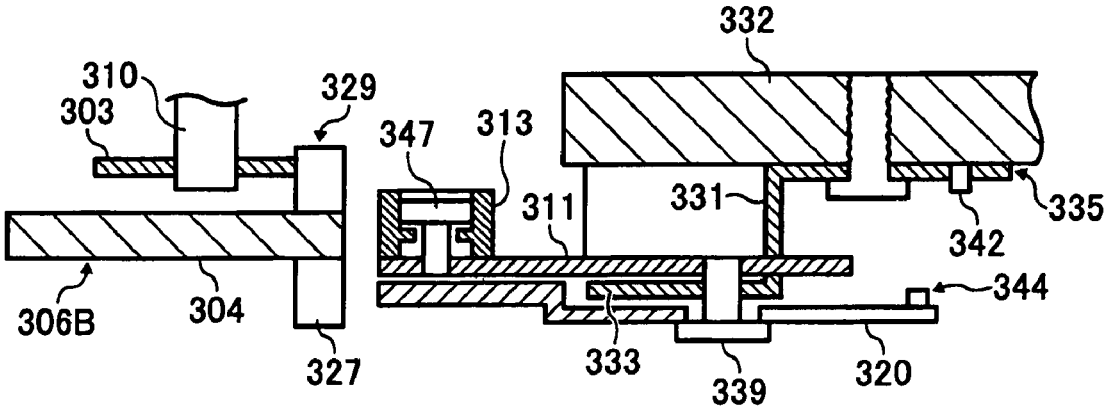
FIG. 22 is a cross-sectional view of the fixing device along the line E-E in FIG. 21.

As an advantage of the pressure mechanism 315 in the fixing device 300 according to the third embodiment, the release lever 320 is oscillatably supported. As shown in FIG. 21, even though the oscillating lever 304 is in the pressurizing position irregularly, the side cover 202 can be closed. FIG. 21 depicts the side cover 202 is closed when the oscillating lever 304 is in the pressurizing position. FIG. 22 is a cross-sectional view of the pressure mechanism 315 along the line E-E in FIG. 21. The portions identical to those in FIG. 8 are denoted with the same reference numerals and the descriptions of the portions are omitted.

As shown in FIGS. 21 and 22, when the oscillating lever 304 is in the pressurizing position, the engaging lug 327 in the oscillating lever 304 is located near the side cover 202 side rather than the oscillating edge 306B. Therefore, when the oscillating lever 304 is in the pressurizing position, and the side cover 202 is getting closed, the front edge of the release lever 320, which is near the fixing roller 301 side, strikes on the engaging lug 327 in the oscillating lever 304. The front edge of the release lever 320 is extended downward in a tapered shape towards the side cover 202 side. When the side cover 202 is further getting closed, the release lever 320 oscillates clockwise centering around the first fixing pin 337 surpassing the bias force of the release spring 345 because the front edge of the release lever 320 is guided by the engaging lug 327. As a result, the front edge of the release lever 320 moves upward, and the hook unit 328 in the release lever 320 gets over the engaging lug 327.

After the hook unit 328 overrides the engaging lug 327, the release lever 320 oscillates counterclockwise by the bias force of the release spring 345, and the hook unit 328 can be located at a position as shown in FIG. 20 that is a state when the side cover 202 is closed. Then, the press roller 313 in the clamp lever 311 strikes on the oscillating edge 306B. When the side cover 202 is further getting closed, the clamp lever 311 moves upward surpassing the bias force of the clamp spring 349 with guided by the oscillating edge 306B. When the side cover 202 is closed, the front edge of the clamp lever 311 moves to a second position that is located above the front edge of the release lever 320.

In the irregular state such that the oscillating lever 304 is in the pressurizing position even though the side cover 202 is opened, when the side cover 202 is closed, the state as shown in FIG. 20 can be obtained in the same manner as the state that the side cover 202 is closed properly. Therefore, the pressure mechanism 315 can be in the pressurizing condition or the pressure-released condition according to an opening or closing of the side cover 202.

Figure 23:
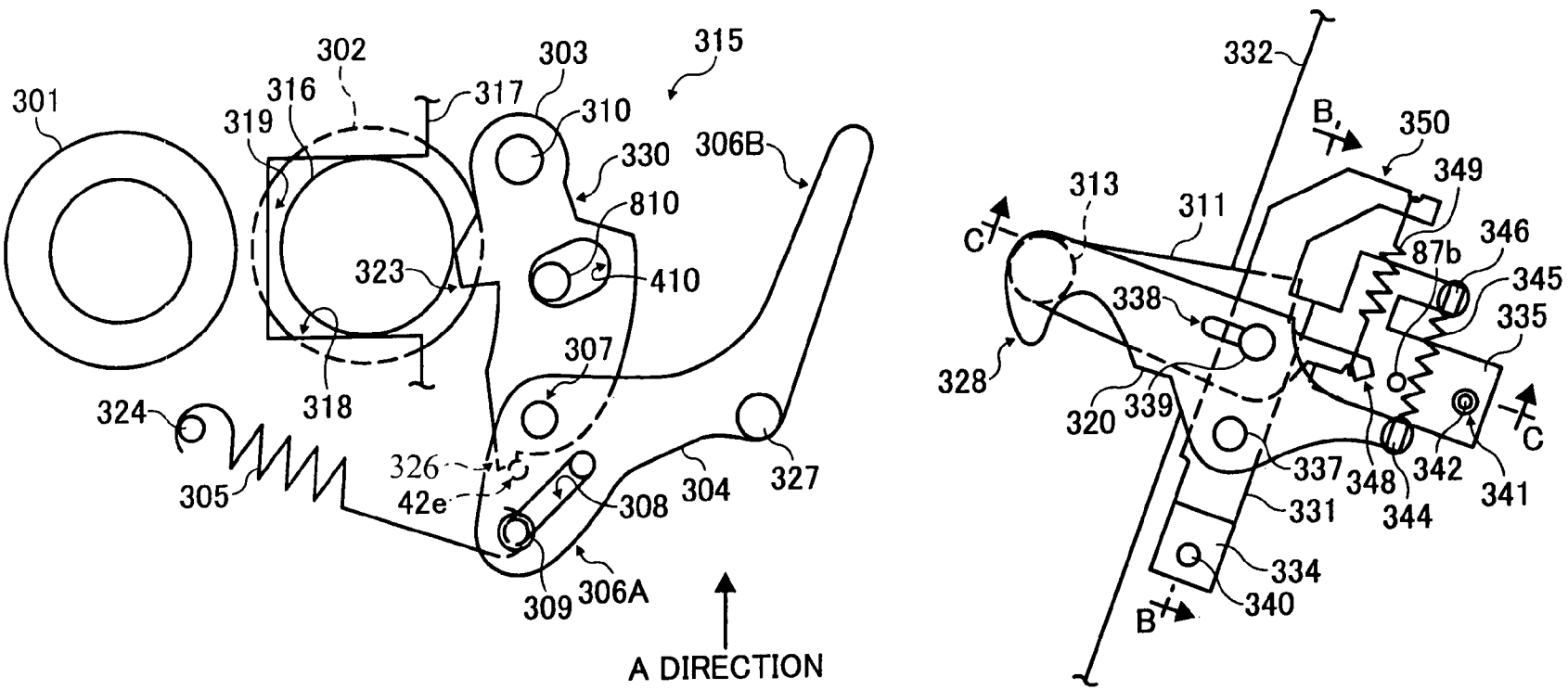
FIG. 23 is a diagram of the fixing device when a pin extended from a side face of a main body of the fixing device is inserted into a long hole included on a pressure lever to restrict an oscillation amount of the pressure lever.

As shown in FIG. 23, the pressure lever 303 includes a long hole 410. A pin 810 extended from the side surface of the main body of the device or the fixing device 300 is inserted into the long hole 410, so that an oscillating amount of the pressure lever 303 is limited. In the configuration, the pressure lever 303 can prevent from oscillating widely when the sheet P is imposed. As a result, the pressure lever 303 can prevent from scratching other members by struck thereon. Furthermore, when the oscillating lever 304 is in the pressure-released position, the pin 810 strikes on the long hole 410, so that the pressure lever 303 is restricted in movement. Therefore, the oscillating lever 304 can be prevented from tottering in the pressure-released position. In the result, when the side cover 202 is closed, the press roller 313 in the clamp lever 311 can surely contact the oscillating edge 306B in the oscillating lever 304.

As described above, in the pressure mechanism 315 in the fixing device 300 according to the third embodiment, when the pressure roller 302 pressurizes or releases to pressurize the fixing roller 301 based on an open-close movement of the side cover 202, a resistance to closing the side cover 202 can be reduced. Thus, the operability of the side cover 202 can be improved. Furthermore, in the irregular state such that the pressure mechanism 315 is in the pressurizing condition even though the side cover 202 is opened, the side cover 202 can be opened or closed properly. Therefore, a user can easily remove the jammed sheet P when the side cover 202 is opened.

In the pressure mechanism 315 in the fixing device 300 according to the third embodiment, the long hole 308 and the latch pin 309 serve as bias force switching units. The pressure mechanism 315 in which the latch pin 309 serves as a bias force switching unit is also applicable to the fixing device as shown in FIGS. 24A, 24B, and 25.

The pressure mechanism 315 is also applicable to a sheet conveying apparatus. For example, one of the pair of paper stop rollers as a rotating unit is pressurized so as to form a nip portion by contacting the other paper stop roller. A sheet is held in the nip portion, and conveyed by a rotation of the pair of paper stop rollers.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying apparatus comprising:

a conveying unit that conveys a sheet by holding in a nip portion, the nip portion formed by a pair of rollers as a rotating unit such that one of the pair of rollers contacts and pressurizes the other roller;

a pressure lever of which a fixed edge is oscillatably supported by an immovable portion, the pressure lever including an oscillating edge, the oscillating edge of the pressure lever being capable of contacting a supporting shaft of a pressure roller;

an oscillating lever of which a fixed edge is oscillatably supported by the pressure lever in the oscillating edge side, the oscillating lever including a plurality of oscillating edges around the fixed edge of the oscillating lever; and an elastic unit that is latched between the fixed edge of the oscillating lever and the immovable portion, and biases the oscillating lever towards the one of the pair of rollers, wherein a position of the fixed edge of the oscillating lever, from among positions at which an end of the elastic unit is latched on, is capable of being changed in a state of being deviated from a position before oscillating based on an oscillating position of the oscillating lever separately from an oscillation of the fixed edge of the oscillating lever.

2. The sheet conveying apparatus according to claim 1, wherein a latch position of the elastic unit in the oscillating lever is displaceable along a direction approaching to a tangent to an oscillating locus of the oscillating lever around the fixed edge of the oscillating lever, and the oscillating lever can be displaced between a position in which the oscillating lever biases the one of the pair of rollers on the oscillating locus and a position in which the oscillating lever moves away from the one of the pair of rollers separately from an oscillation of the fixed edge of the oscillating lever.

3. The sheet conveying apparatus according to claim 1, wherein the oscillating lever includes a long hole at the latch position, which the end of the elastic unit is latched on, and a supporting pin is put in the long hole and is longitudinally movable in the long hole based on an oscillating position of the fixed edge of the oscillating lever.

4. The sheet conveying apparatus according to claim 1, wherein the elastic unit is latched at a first end at the oscillating edge of the oscillating lever and at a second end at a fixed point.

5. The sheet conveying apparatus according to claim 1, wherein the oscillating edge of the oscillating lever is forked and includes a latch pin between the forks.

6. The sheet conveying apparatus according to claim 5, wherein the elastic unit is attached to the oscillating lever at the latch pin.

7. The sheet conveying apparatus according to claim 5, wherein the oscillating lever includes an elongated hole at the oscillating edge and the latch pin is freely displaceable in the elongated hole.

8. The sheet conveying apparatus according to claim 1, wherein the oscillating lever includes a linear portion between the plurality of oscillating edges, the linear portion being on a movement path of one of the pair of rollers.

9. A sheet conveying apparatus comprising:

a conveying unit that conveys a sheet by holding in a nip portion, the nip portion formed by a pair of rollers as a rotating unit such that one of the pair of rollers contacts and pressurizes the other roller;

a pressure lever of which a fixed edge is oscillatably supported by a fixed supporting unit, the pressure lever including a pressurizing unit that can contact a rotating shaft of a pressure roller; and a press lever of which a fixed edge is oscillatably supported by the pressure lever in an oscillating edge side, the press lever pressing an oscillating lever to oscillate from a pressure-released position to a pressurizing position, wherein while the press lever presses the oscillating lever to oscillate from the pressure-released position to the pressurizing position, the press lever oscillates to move away from a supporting point of the oscillating lever.

10. The sheet conveying apparatus according to claim 9, wherein a direction of a moment that the press lever receives from the oscillating lever is switched to a direction to move away from the supporting point of the oscillating lever while the oscillating lever oscillates from the pressure-released position to the pressurizing position.

11. The sheet conveying apparatus according to claim 9, wherein a contact surface between the press lever and the oscillating lever is a curved surface, and when an angle between the contact surface and a line connecting a contact point between the press lever and the oscillating lever with the supporting point of the press lever is 90 degrees, the direction of the moment that the press lever receives from the oscillating lever is switched.

12. The sheet conveying apparatus according to claim 11 further comprising:

a bias unit that biases a front edge of the press lever in a direction approaching the supporting point of the oscillating lever.

13. The sheet conveying apparatus according to claim 9, wherein the press lever includes a rotatable roller, and the roller contacts the oscillating lever.

14. The sheet conveying apparatus according to claim 9 further comprising:

a release lever that is engaged with an engaging lug located on the oscillating lever, and makes the oscillating lever oscillate from the pressurizing position to the pressure-released position, wherein the oscillating lever oscillates between the pressurizing position and the pressure-released position, and the release lever is oscillatably supported by the engaging lug.

15. The sheet conveying apparatus according to claim 14, wherein a front edge of the release lever includes an inclined surface.

16. The sheet conveying apparatus according to claim 14 further comprising:

a bias unit that biases the release lever in a direction opposite to an oscillating direction when the release lever strikes on the engaging lug.

17. The sheet conveying apparatus according to claim 14 further comprising:

a press lever that presses the oscillating lever to oscillate from the pressure-released position to the pressurizing position, wherein the press lever oscillates to move away from the supporting point of the oscillating lever while the press lever presses the oscillating lever to oscillate from the pressure-released position to the pressurizing position.

18. An image forming apparatus comprising:

a sheet conveying apparatus including a conveying unit that conveys a sheet by holding in a nip portion, the nip portion formed by a pair of rollers as a rotating unit such that one of the pair of rollers contacts and pressurizes the other roller;

a pressure lever of which a fixed edge is oscillatably supported by a immovable portion, the pressure lever including an oscillating edge, the oscillating edge of the pressure lever being capable of contacting a supporting shaft of a pressure roller;

an oscillating lever of which a fixed edge is oscillatably supported by the pressure lever in the oscillating edge side, the oscillating lever including a plurality of oscillating edges around the fixed edge of the oscillating lever; and an elastic unit that is latched between the fixed edge of the oscillating lever and the immovable portion, and biases the oscillating lever towards the one of the pair of rollers, wherein a position of the fixed edge of the oscillating lever, from among positions at which an end of the elastic unit is latched on, is capable of being changed in a state of being deviated from a position before oscillating based on an oscillating position of the oscillating lever separately from an oscillation of the fixed edge of the oscillating lever.

* * * * *